US009470992B2

(12) United States Patent
Uchino et al.

(10) Patent No.: US 9,470,992 B2
(45) Date of Patent: Oct. 18, 2016

(54) IMAGE FORMING METHOD

(71) Applicant: Konica Minolta, Inc., Tokyo (JP)

(72) Inventors: Satoshi Uchino, Hino (JP); Shinya Obara, Fuchu (JP); Yasuko Uchino, Hino (JP); Ikuko Sakurada, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/628,831

(22) Filed: Feb. 23, 2015

(65) Prior Publication Data

US 2015/0248069 A1 Sep. 3, 2015

(30) Foreign Application Priority Data

Feb. 28, 2014 (JP) ..... 2014-037793

(51) Int. Cl.

*G03G 9/097* (2006.01)
*G03G 9/08* (2006.01)
*G03G 9/087* (2006.01)

(52) U.S. Cl.

CPC ..... *G03G 9/0819* (2013.01); *G03G 9/0825* (2013.01); *G03G 9/0827* (2013.01); *G03G 9/08711* (2013.01); *G03G 9/08755* (2013.01); *G03G 9/09716* (2013.01); *G03G 9/09725* (2013.01)

(58) Field of Classification Search

CPC ..... G03G 9/0819; G03G 9/0825; G03G 9/0827; G03G 9/08755; G03G 9/08711; G03G 9/09725; G03G 9/09716

See application file for complete search history.

(56) References Cited

U.S. PATENT DOCUMENTS

2003/0118929 A1* 6/2003 Shirai ..... G03G 9/08755 430/108.7
2006/0029878 A1* 2/2006 Yoshizawa ..... G03G 5/0614 430/123.43

(Continued)

FOREIGN PATENT DOCUMENTS

JP 2002-162773 * 6/2002 ..... G03G 9/08
JP 2003-302791 * 10/2003 ..... G03G 9/087

(Continued)

OTHER PUBLICATIONS

Translation of JP 2003-302791 published Oct. 2003.*

(Continued)

*Primary Examiner* — Peter Vajda
(74) *Attorney, Agent, or Firm* — Lucas & Mercanti, LLP

(57) ABSTRACT

An image forming method includes: charging a surface of an electrostatic latent image holder with a charging roller; exposing the charged surface so as to form an electrostatic latent image; and developing the formed electrostatic latent image with toner. The toner contains at least a toner base particle and an external additive minute particle. The external additive minute particle contains a silica-polymer composite minute particle. A silicon atom abundance ratio obtained from abundances of a carbon atom, an oxygen atom and a silicon atom present on an outermost surface and within 3 nm from the outermost surface in a depth direction of the silica-polymer composite minute particle are measured with an x-ray photoelectron spectrometer satisfies at least the following condition A.

15.0 atm %≤silicon atom abundance ratio ({Si/(C+O+Si)}×100)≤30.0 atm % [Condition A]

10 Claims, 1 Drawing Sheet

(56) References Cited

U.S. PATENT DOCUMENTS

| | | | | |
|---|---|---|---|---|
| 2010/0279223 | A1* | 11/2010 | Sukeno | G03G 9/0827 430/109.4 |
| 2013/0164665 | A1* | 6/2013 | Ishii | G03G 9/08 430/105 |
| 2014/0295341 | A1* | 10/2014 | Fomitchev | G03G 9/09716 430/108.22 |

FOREIGN PATENT DOCUMENTS

| | | | |
|---|---|---|---|
| JP | 2005082765 | A | 3/2005 |
| JP | 2006078774 | A | 3/2006 |
| JP | 3902943 | B2 | 1/2007 |
| JP | 2007127952 | A | 5/2007 |
| JP | 2009075572 | A | 4/2009 |
| JP | 2010113017 | A | 5/2010 |
| JP | 2011257526 | A | 12/2011 |
| JP | 2013092748 | A | 5/2013 |

OTHER PUBLICATIONS

Translation of JP 2002-162773 published Jun. 2002.*

Office Action from corresponding Japanese Application; Patent Application No. 2014-037793; Drafting Date: Jan. 26, 2016; Applicant: Koyo Internatnional Patent Firm/ Ref. No. B32600JP01; Dispatch No. 037339; Dispatch Date Feb. 2, 2016; total of 9 pages. English translation of Office Action above; Total of 3 pages.

* cited by examiner

IMAGE FORMING METHOD

FIELD OF THE INVENTION

The present invention relates to an image forming method, in particular, an electrophotographic image forming method employing a system of charging with a roller and being capable of stably forming high-quality images without image defects over a long period.

DESCRIPTION OF THE RELATED ART

In recent years, because an electrophotographic image forming apparatus has been able to easily send and receive data, digital data in particular, with the development of the network utilizing personal computers, it has been common that the image forming apparatus not only makes simple copies but also creates original images (desktop publishing), such as items for distribution and publications, by directly outputting documents and images created on a personal computer. Because the image forming apparatus can easily capture digital color images, for creating the original images, the image forming apparatus is required to form high-quality images. Further, the image forming apparatus is required to be smaller and lighter for convenience because in a small-sized office or the like, there is a problem in space and hence the image forming apparatus is used, for example, by being placed beside a desk.

In an electrophotographic image forming method, it is necessary to uniformly charge an electrostatic latent image holder (also called a "photosensitive body"). For that, a charging device employing a system of charging with corona is generally used. This kind of charging device has an advantage of easy use because the configuration and the operation thereof are simple. However, the corona discharge generates ozone, this ozone generates oxide, and this oxide generates defects on the surface of the electrostatic latent image holder, thereby causing image defects such as image blurring onto the images to be formed. Therefore, the charging device cannot stably form images over a long period.

In order to solve this problem, there has been proposed using a charging roller in a charging device. (Refer to, for example, Japanese Patent No. 3902943.) The charging device with a charging roller does not generate ozone at the charged part, and also makes an image forming apparatus such as a printer smaller because the charging roller is much smaller than the charging device employing a system of charging with corona.

However, the image forming method employing a system of charging with a roller, namely, using a charging roller, has a problem that, in the long run, the charging roller is partly worn by a highly abrasive external additive, such as silica particles or titania particles, contained in toner and consequently cannot uniformly charge the surface of the electrostatic latent image holder, and therefore causes non-uniform charging and is incapable of stably forming images over a long period.

BRIEF SUMMARY OF THE INVENTION

The present invention has been conceived giving consideration to the above problems and circumstances, and objects of the present invention include providing an image forming method employing a system of charging with a roller, the image forming method being capable of forming over a long period high-quality images without image defects caused by non-uniform charging.

The present inventors have examined the causes and so forth of the above problems in order to achieve the above objects and found out that the above objects can be achieved by using toner containing silica-polymer composite minute particles as an external additive in an image forming method employing a system of charging with a roller. Thus, the present inventors have conceived the present invention.

That is, the above objects of the present invention are achieved by the following means.

1. An image forming method including: charging a surface of an electrostatic latent image holder with a charging roller; exposing the charged surface so as to form an electrostatic latent image; and developing the formed electrostatic latent image with toner, wherein the toner contains at least a toner base particle and an external additive minute particle, the external additive minute particle contains a silica-polymer composite minute particle, and a silicon atom abundance ratio obtained from abundances of a carbon atom, an oxygen atom and a silicon atom present on an outermost surface and within 3 nm from the outermost surface in a depth direction of the silica-polymer composite minute particle measured with an x-ray photoelectron spectrometer satisfies at least a condition A below.

$$15.0 \text{ atm } \% \leq \text{silicon atom abundance ratio } (\{Si/(C+O+Si)\}\times 100) \leq 30.0 \text{ atm } \% \quad \text{[Condition A]}$$

2. The image forming method according to the above item 1, wherein the silica-polymer composite minute particle has a number average primary particle diameter of 50 nm to 500 nm.

3. The image forming method according to the above item 1, wherein the toner is toner containing the toner base particle having a domain-matrix structure, the matrix contains an acid group-containing vinyl-based polymer, and the domain contains a polymer formed of a vinyl-based polymerization segment and a polyester polymerization segment binding to each other.

4. The image forming method according to the above item 1, wherein, as a hydrophobizing agent of the silica-polymer composite minute particle, at least methacryloxypropyltrimethoxysilane is used.

5. The image forming method according to the above item 1, wherein, as a hydrophobizing agent of the silica-polymer composite minute particle, at least hexamethyldisilazane is used.

6. The image forming method according to the above item 1, wherein a silica part of the silica-polymer composite minute particle is formed of a colloidal silica minute particle.

7. The image forming method according to the above item 1, wherein a silica part of the silica-polymer composite minute particle has a particle diameter of 10 nm to 70 nm.

8. The image forming method according to the above item 1, wherein the toner base particle has a number average particle diameter of 4.0 μm to 6.8 μm.

9. The image forming method according to the above item 1, wherein the toner base particle has an average roundness of 0.930 to 0.965.

10. The image forming method according to the above item 1 further including applying a direct current and an alternating current to the charging roller.

11. The image forming method according to the above item 1, wherein the charging roller has a surface roughness Rz of 5 μm to 10 μm.

BRIEF DESCRIPTION OF THE SEVERAL VIEWS OF THE DRAWING

The present invention is fully understood from the detailed description given hereinafter and the accompanying drawings, which are given byway of illustration only and thus are not intended to limit the present invention, wherein.

DETAILED DESCRIPTION OF THE INVENTION

Figure 1:
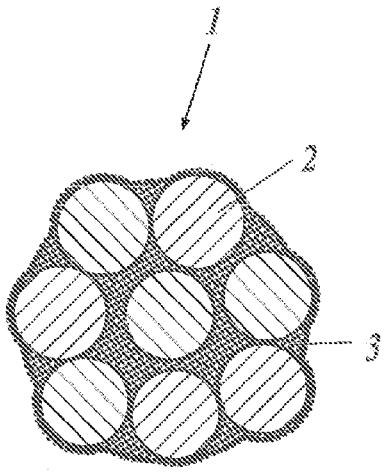
FIG. 1 is a schematic view to explain the shape of a silica-polymer composite minute particle of the present invention.

An image forming method of the present invention is an image forming method of: charging the surface of an electrostatic latent image holder with a charging roller; exposing the charged surface so as to form an electrostatic latent image; and developing the formed electrostatic latent image with toner. The toner contains at least a toner base particle(s) and an external additive minute particle(s). The external additive minute particle contains a silica-polymer composite minute particle(s). A silicon atom abundance ratio obtained from abundances of a carbon atom(s), an oxygen atom(s) and a silicon atom(s) present on the outermost surface and within 3 nm from the outermost surface in the depth direction of the silica-polymer composite minute particle measured with an x-ray photoelectron spectrometer satisfies at least the above condition A.

As an embodiment of the present invention, it is preferable in terms of demonstrating effects of the present invention that the silica-polymer composite minute particle has a number average primary particle diameter of 50 nm to 500 nm. Consequently, a proper degree of an abrasion effect can be obtained.

Further, it is preferable that the toner be toner containing the toner base particle having a domain-matrix structure, the matrix contain an acid group-containing vinyl-based polymer, and the domain contain a polymer formed of a vinyl-based polymerization segment and a polyester polymerization segment binding to each other. It is considered that the toner base particle has a domain-matrix structure, so that the hardness of the toner base particle has distribution, and this hardness distribution properly adjusts adhesiveness of the silica-polymer composite minute particle to the toner base particle and also properly adjusts the desorption amount of the silica-polymer composite minute particle, which serves as an abrasive.

Hereinafter, components of the present invention and forms/modes for carrying out the present invention are detailed. Note that, in the present application, "-(to)" between values is used to mean that the values before and after the sign are inclusive as the lower limit and the upper limit.

<<Summary of Image Forming Method>>

The image forming method of the present invention is an image forming method of: charging the surface of an electrostatic latent image holder with a charging roller; exposing the charged surface so as to form an electrostatic latent image; and developing the formed electrostatic latent image with toner. The toner contains at least a toner base particle(s) and an external additive minute particle(s). The external additive minute particle contains a silica-polymer composite minute particle(s). A silicon atom abundance ratio obtained from abundances of a carbon atom(s), an oxygen atom(s) and a silicon atom(s) present on the outermost surface and within 3 nm from the outermost surface in the depth direction of the silica-polymer composite minute particle measured with an x-ray photoelectron spectrometer satisfies at least the following condition A.

$$15.0 \text{ atm } \% \leq \text{silicon atom abundance ratio } (\{Si/(C+O+Si)\} \times 100) \leq 30.0 \text{ atm } \% \quad \text{[Condition A]}$$

Hereinafter, the components of the present invention are detailed.

<<Silica-Polymer Composite Minute Particles>>

A silica-polymer composite minute particle(s) of the present invention is composed of silica minute particles and a polymer, and is contained in the surface of a toner base particle(s) as an external additive, thereby adhering to the surface of the toner base particle. The surface of the silica minute particles of the silica-polymer composite minute particle is modified with a first hydrophobizing agent, and a polymerizable functional group(s), such as a vinyl group(s) and an acryloxy group(s), which the first hydrophobizing agent has is polymerized, whereby the polymer is formed. Thus, the silica-polymer composite minute particle is formed.

FIG. 1 is a schematic view to explain the shape of a silica-polymer composite minute particle 1 of the present invention. In FIG. 1, the "2" represents the silica minute particles, and the "3" represents the polymer formed of the first hydrophobizing agent. The silica minute particles 2 bind to and are dispersed in the polymer 3, and form the silica-polymer composite minute particle 1 in such a way that the silica minute particles 2 are present in the silica-polymer composite minute particle 1 relatively near the surface thereof, and the heads of some of the silica minute particles 2 appear above the silica-polymer composite minute particle 1.

The silica-polymer composite minute particle has a silicon atom abundance ratio which satisfies at least the condition A below. The silicon atom abundance ratio is calculated from the abundances of carbon atoms, oxygen atoms and silicon atoms present on the outermost surface and within 3 nm from the outermost surface in the depth direction of the silica-polymer composite minute particle measured with an x-ray photoelectron spectrometer.

$$15.0 \text{ atm } \% \leq \text{silicon atom abundance ratio } (\{Si/(C+O+Si)\} \times 100) \leq 30.0 \text{ atm } \% \quad \text{[Condition A]}$$

The silicon atom abundance ratio is a value obtained as follows.

(Measurement of Silicon Atom Abundance Ratio)

The silicon atom abundance ratio of the silica-polymer composite minute particle is obtained as follows; with an x-ray photoelectron spectrometer "K-Alpha" (from Thermo Fisher Scientific K.K.), quantitative analysis of carbon atoms, oxygen atoms and silicon atoms are conducted under the following conditions, and the concentrations of the elements of the silica-polymer composite minute particle on the outermost surface and within 3 nm from the outermost surface in the depth direction of the silica-polymer composite minute particle (i.e., the surface element concentrations of the silica-polymer composite minute particle) are calculated from the atom peak areas of the elements with relative sensitivity factors.

(Measurement Conditions)

X-ray: monochromatic Al x-ray source

Acceleration: 12 kV, 6 mA

Resolution: 50 eV

Beam diameter: 400 μm

Path energy: 50 eV

Step size: 0.1 eV

When the silicon atom abundance ratio is less than 15.0 atm %, the amount of silicon atoms is too small, so that the abrasion effect cannot be demonstrated well, whereas when the silicon atom abundance ratio is more than 30.0 atm %, the abrasion effect is demonstrated too much, which damages the photosensitive body and/or the charging roller.

The silicon atom abundance ratio to be measured includes both silicon atoms of the silica minute particles and silicon atoms of the first hydrophobizing agent. The silicon atom abundance ratio can be controlled with the number average primary particle diameter of the silica minute particles, the addition of the silica minute particles, the addition of the first hydrophobizing agent, which has silicon atoms, the amount of a copolymerizable monomer and/or the amount of a crosslinking agent.

<Silica>

The silica minute particles preferably used for the silica-polymer composite minute particle of the present invention are produced with a well-known method. Examples of the method for producing the silica minute particles include: dry processes (also called "gas phase methods") such as a combustion method and an arc method; and wet processes such as a precipitation method, a gel method and a sol-gel method.

The silica minute particles suitable for the present invention include but are not limited to precipitated silica minute particles and colloidal silica minute particles. These types of silica minute particles may be produced by well-known methods or commercially available.

Precipitated silica minute particles may be produced by conventional methods and are often formed by coagulation of particles to be a desired size from an aqueous medium under the high salt concentration, acids, or other coagulants. The silica minute particles are filtered, washed, dried, and separated from residues of other reaction products by well-known conventional methods. Precipitated particles are often aggregated in the sense that numerous primary particles coagulate to one another to form a somewhat spherical aggregated cluster. This aggregated cluster is the structural difference from fumed silica or particles prepared with heat (having a chain structure of aggregate primary particles, wherein the primary particles fuse). Commercially available precipitated silica include Hi-Sil® products from PPG Industries, Inc. and SIPERNAT® products available from Degussa Co.

Other usable silica minute particles may be produced by the methods described in U.S. Pat. Nos. 4,755,368 and 6,702,994, and Mueller, et al., "Nanoparticle synthesis at high production rates by flame spray pyrolysis", Chemical Engineering Science, 58: 1969 (2003).

Colloidal silica minute particles are often non-aggregated, individually discrete (primary) particles, which are spherical or nearly spherical in shape, but can have other shapes (e.g., shapes with generally elliptical, square, or rectangular cross-sections). Colloidal silica minute particles are commercially available or can be produced by well-known methods from various starting materials (e.g., wet-process type silica). Colloidal silica minute particles are typically fabricated in a manner similar to precipitated silica minute particles (i.e., they are coagulated from an aqueous medium) but may be obtained in a state of being dispersed in a liquid medium (water alone or water with a co-solvent and optionally with a stabilizing agent). The silica minute particles can be prepared, for example, from silicic acid derived from an alkali silicate solution having a pH of 9 to 11, wherein the silicate anions undergo polymerization to produce individually discrete silica minute particles having a desired average particle diameter in the form of an aqueous dispersion. Typically, the colloidal silica starting material is available as a sol, which is a dispersion of colloidal silica in a suitable solvent (most often water alone or water with a co-solvent and optionally with a stabilizing agent).

These are described, for example, in Stoeber, et al., Controlled Growth of Monodisperse Silica Spheres in the Micron Size Range, Journal of Colloid and Interface Science, 26, 1968, pp. 62-69; Akitoshi Yoshida, Silica Nucleation, Polymerization, and Growth Preparation of Monodispersed Sols, in Colloidal Silica Fundamentals and Applications, pp 47-56 (H. E. Bergna & W. O. Roberts, eds., CRC Press: Boca Raton, Fla., 2006); and Iler, R. K., The Chemistry of Silica, p 866 (John Wiley & Sons: New York, 1979).

Commercially available colloidal silica suitable for use in the present invention include SNOWTEX® products from Nissan Chemical, Industries, Inc., LUDOX® products available from W.R. Grace & Co., NexSil™ and NexSil A™ series products available from Nyacol Nanotechnologies, Inc., Quartron™ products available from Fuso Chemical, Co., Ltd., and Levasil® products available from AkzoNobel N.V.

Colloidal silica minute particles have a number average primary particle diameter of preferably 5 nm to 100 nm, far preferably 10 nm to 70 nm and particularly preferably 20 nm to 50 nm. The silica minute particles may be non-aggregated (for example, substantially spherical) or aggregated a little. For example, the ratio of the aggregation diameter to the number average primary particle diameter is within a range preferably from 1.0 to 3.0, far preferably from 1.0 to 2.0 and particularly preferably from 1.0 to 1.5. The particle diameter may be measured by dynamic light scattering (DLS).

The silica minute particles are treated with the first hydrophobizing agent. The first hydrophobizing agent has: a group(s) reactive to a hydroxy group(s) present on the surface of the silica minute particles; and a polymerizable functional group(s) forming the polymer.

The degree of hydrophobicity imparted to the hydrophobic silica minute particles varies depending upon the type and the amount of a hydrophobizing agent. It is preferable that 15% to 85% of the hydroxy group on the surface of the silica minute particles be reacted, and it is far preferable that 50% to 85% of the hydroxy group thereon be reacted.

The first hydrophobizing agent is preferably a compound represented by the following General Formula (1).

[Chem. 1]

General Formula (1)

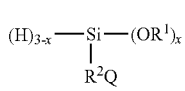

x represents 1, 2 or 3; $R^1$ represents a methyl group or an ethyl group; $R^2$ represents an alkylene group represented by a general formula $C_nH_{2n}$, wherein n represents an integer between 1 and 10; and Q represents a substituted or unsubstituted vinyl group, a substituted or unsubstituted acryloxy group (acryloyloxy group) or a substituted or unsubstituted methacryloxy group (methacryloyloxy group).

Preferred hydrophobizing agents for use as the first hydrophobizing agent are vinyltriacetoxysilane, (3-acryloxypropyl)trimethoxysilane, (3-acryloxypropyl)triethoxysilane, methacryloxypropyltrimethoxysilane, methacryloxypropyltriethoxysilane, methacryloxymethyltrimethoxysilane, methacryloxymethyltriethoxysilane, (3-acryloxypropyl) methyldimethoxysilane, methacryloxypropylmethyldimethoxysilane, methacryloxypropyldimethylethoxysilane, methacryloxypropyldimethylmethoxysilane, allyltrimethoxysilane, vinyltriethoxysilane, vinyltrimethoxysilane, and vinyltris(2-methoxyethoxy)silane.

The silica minute particles may additionally be treated with a second hydrophobizing agent, either before or after the treatment with the first hydrophobizing agent or after formation of the silica-polymer composite minute particle, in which case only the exposed surface of the silica minute particles is treated. Preferred hydrophobizing agents for use as the second hydrophobizing agent are silazane compounds, siloxane compounds and silane compounds, and silicone oils having some solubility in water with or without a co-solvent. Preferably, silicone oils for use as the second hydrophobizing agent have a number average molecular weight of at most 10,000. The second hydrophobizing agent may be selected from the silazane compounds, siloxane compounds and silane compounds, and silicone oils having a number average molecular weight of at most 10,000. Examples of the silane compounds include alkylsilane and alkoxysilane.

Alkylsilane is preferably a compound represented by the following General Formula (2).

$$R^3_xSi(OR^4)_{4-x} \qquad \text{General Formula (2)}$$

$R^3$ represents a $C_1$-$C_{30}$ branched or straight chain alkyl group, an alkenyl group, a $C_3$-$C_{10}$ cycloalkyl group, or a $C_6$-$C_{10}$ aryl group; R4 represents a $C_1$-$C_{10}$ branched or straight chain alkyl group; and x represents an integer between 1 and 3.

Where the metal oxide does not include silica, the second hydrophobizing agent is preferably di- or tri-functional silane, siloxane or silicone oil.

Preferred examples of the silane compounds usable as the second hydrophobizing agent include trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-octyltriethoxysilane, n-hexadecyltrimethoxysilane, and n-octadecyltrimethoxysilane. Preferred examples of the siloxane compounds useful for the present invention include octamethylcyclotetrasiloxane and hexamethylcyclotrisiloxane. Preferred examples of the silazane compounds useful for the present invention include hexamethyldisilazane (HMDS), hexamethylcyclotrisilazane, and octamethylcyclotetrasilazane. For example, HMDS may be used to cap unreacted hydroxy groups on the surface of the silica minute particles. Exemplary hydrophobizing agents also include hexamethyldisilazane, isobutyltrimethoxysilane, octyltrimethoxysilane and the cyclic silazane described in U.S. Pat. No. 5,989,768. Such cyclic silazane is represented by the following General Formula (3).

[Chem. 2]

General Formula (3)

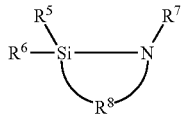

$R^5$ and $R^6$ are independently selected from the group consisting of a hydrogen atom, a halogen atom, an alkyl group, an alkoxy group, an aryl group and an aryloxy group; $R^7$ is selected from the group consisting of: hydrogen; $(CH_2)_rCH_3$, wherein r represents an integer between 0 and 3; $C(O)(CH_2)_rCH_3$, wherein r represents an integer between 0 and 3; $C(O)NH_2$; $C(O)NH(CH_2)_rCH_3$, wherein r represents an integer between 0 and 3; and $C(O)N[(CH_2)_rCH_3](CH_2)_sCH_3$, wherein r and s represent integers between 0 and 3; and $R^8$ is represented by the following General Formula (4).

$$[(CH_2)_a(CHX)_b(CYZ)_c] \qquad \text{General Formula (4)}$$

X, Y and Z are independently selected from the group consisting of a hydrogen atom, a halogen atom, an alkyl group, an alkoxy group, an aryl group and an aryloxy group; and a, b and c represent integers between 0 and 6 satisfying the condition that (a+b+c) equals an integer between 2 and 6.

The cyclic silazane suitable for the present invention is a five or six member ring represented by the following General Formula (5).

[Chem. 3]

General Formula (5)

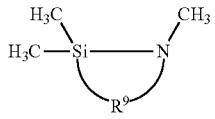

$R^9$ is represented by the following General Formula (6).

$$[(CH_2)_a(CHX)_b(CYZ)_c] \qquad \text{General Formula (6)}$$

X, Y and Z are independently selected from the group consisting of a hydrogen atom, a halogen atom, an alkyl group, an alkoxy group, an aryl group and an aryloxy group; and a, b and c represent integers between 0 and 6 satisfying the condition that (a+b+c) equals an integer between 3 and 4.

The silicone oils suitable as the second hydrophobizing agent include both non-functionalized silicone oils and functionalized silicone oils. Depending on the conditions used to surface-treat the silica minute particles and the particular silicone oil employed, the silicone oil may exist as a non-covalently bonded coating or may be covalently bonded to the surface of the silica minute particles.

Preferred examples of the non-functionalized silicone oils useful for the present invention include polydimethylsiloxane, polydiethylsiloxane, phenylmethylsiloxane copolymers, fluoroalkylsiloxane copolymers, diphenylsiloxane-dimethylsiloxane copolymers, phenylmethylsiloxane-dimethylsiloxane copolymers, phenylmethylsiloxane-diphenylsiloxane copolymers, methylhydrosiloxane-dimethylsiloxane copolymers, and polyalkylene oxide modified silicone.

The functionalized silicone oils are silicone oils having functional groups reactive to organic groups on both terminals or on one terminal of silicone. The functionalized silicone oils can have, for example, functional groups selected from the group consisting of vinyl groups, hydroxy groups, thiol groups, silanol groups, amino groups and epoxy groups. The functional groups may be bonded directly to the silicone polymer backbone or may be bonded thereto through alkyl, alkenyl or aryl groups.

In the present invention, the dimethylsiloxane copolymers described in U.S. Patent Application Publication No. 2012/798540 filed on Apr. 6, 2010 may be used to treat the silica minute particles.

As an exemplary dimethylsiloxane copolymer, a copolymer represented by the following General Formula (7) is preferable.

[Chem. 4]

General Formula (7)

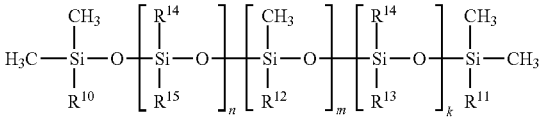

$R^{10}$ represents a hydrogen atom or a methyl group; $R^{11}$ represents a hydrogen atom or a methyl group; $R^{12}$ represents a methyl group, an ethyl group, an n-propyl group, an aralkyl group (—$CH_2Ar$ or —$CH_2CH_2Ar$), an aryl group, —$CH_2CH_2CF_3$, or —$CH_2CH_2$—$R^f$, wherein $R^f$ represents a $C_1$-$C_8$ perfluoroalkyl group; $R^{13}$ represents a methyl group, an ethyl group, an n-propyl group, a trifluoropropyl group, or —$CH_2CH_2$—$R^f$, wherein $R^f$ represents a $C_1$-$C_8$ perfluoroalkyl group; $R^{14}$ represents a methyl group, an ethyl group, an aralkyl group (—$CH_2Ar$ or —$CH_2CH_2Ar$), or an aryl group; $R^{15}$ represents a hydrogen atom, a hydroxy group, a methoxy group, or an ethoxy group; Ar represents an unsubstituted phenyl group or a phenyl group substituted with one or more methyl groups, halogen atoms, ethyl groups, trifluoromethyl groups, pentafluoroethyl groups or trifluoroethyl groups; and n, m and k represent integers respectively satisfying $n \geq 1$, $m \geq 1$ and $k \geq 0$. The copolymer preferably has a molecular weight of 200 to 20,000.

The second hydrophobizing agent may be a charge control agent. Any of the charge control agents described in U.S. Patent Application Publication No. 2010/0009280 may be employed. Charge control agents preferably used in the present invention include but are not limited to 3-(2,4-dinitrophenylamino)propyltriethoxsilane (DNPS), 3,5-dinitrobenzamido-n-propyltriethoxysilane, 3-(triethoxysilylpropyl)-p-nitrobenzamide (TESPNBA), pentafluorophenyltriethoxysilane (PFPTES), and 2-(4-chlorosulfonylphenyl)ethyltrimethoxysilane (CSPES). Charge control agents containing nitro groups are preferably used to post-treat the silica minute particles after the copolymer, as the hydride groups may reduce the nitro groups.

In addition to the second hydrophobizing agent, the silica minute particles may be treated with a third hydrophobizing agent, and the silica minute particles treated with the second and third hydrophobizing agents may form the silica-polymer composite minute particle.

The third hydrophobizing agent may be alkylhalosilane or silicone oil having a number average molecular weight greater than 10,000.

Alkylhalosilane contains a compound represented by the following General Formula (8).

$$R^3_xSiR^4_yX_{4-x-y}$$ General Formula (8)

$R^3$ and $R^4$ are as defined in General Formula (2); X represents a halogen atom, preferably a chlorine atom; y represents an integer of 1, 2, or 3 satisfying the condition that x+y equals 3.

Where the second hydrophobizing agent and the third hydrophobizing agent are used after formation of the silica-polymer composite minute particle, depending on the interaction between the second and third hydrophobizing agents and the polymer component of the silica-polymer composite minute particle, these hydrophobizing agents may also surface-treat the exposed surface of the silica minute particles of the silica-polymer composite minute particle.

The polymer employed in the silica-polymer composite minute particle may be the same as or different from that of the first hydrophobizing agent. That is, where the first hydrophobizing agent contains a polymerizable group(s), the same material may be used to form the polymer.

In the present invention, other than the hydrophobizing agent containing the polymerizable group, a different monomer which can copolymerize with the terminal group of the first hydrophobizing agent may be employed. Suitable monomers which are used to produce the silica-polymer composite minute particle include substituted and unsubstituted vinyl and acrylate monomers and other monomers which polymerize by radical polymerization. Exemplary monomers include styrene, acrylic ester, methacrylic ester, olefin, vinyl ester, and acrylonitrile, and these are available, for example, from Sigma-Aldrich (Milwaukee, Wis.). Such monomers may be used by themselves, in mixtures to form copolymers, or in conjunction with crosslinking agents described below, as needed.

<Production Method of Silica-Polymer Composite Minute Particles>

The silica-polymer composite minute particle(s) is easily produced by a well-known method. In one exemplary method, an aqueous dispersion is prepared with the first hydrophobizing agent and silica at amass ratio (hydrophobizing agent/silica) of preferably 0.8 to 20.0 and far preferably 1.2 to 16.0. The pH is 8.0 to 8.5, and the dispersion is stirred to form an emulsion (typically 1 to 3 hours) while the temperature is kept at 50° C. to 60° C. Following the stirring, an initiator is introduced as a solution in ethanol or other water-miscible solvent at a level of 1 to 4 mass % with respect to a monomer. Suitable initiators include but are not limited to oil soluble azo or peroxide thermal initiators such as 2,2'-azobis(2-methylpropionitrile) (AIBN), benzoyl peroxide, tert-butyl peracetate, and cyclohexanone peroxide. These initiators are available from Wako Pure Chemical Industries, Ltd. The initiator is dissolved in the monomer prior to the introduction of silica. The resulting solution is incubated at 65° C. to 95° C. with stirring for 4 to 6 hours. The resulting slurry is dried at 100° C. to 130° C. overnight, and the remaining solid is milled to produce powder. Where the second hydrophobizing agent is added after formation of the silica-polymer composite minute particle, it may be added before the drying step. For example, the second hydrophobizing agent is added, and the slurry is stirred for additional 2 to 4 hours at 60° C. to 75° C.

The amount of silica exposed at the surface of the silica-polymer composite minute particle varies depending on the amount of time that the silica minute particles are exposed to (i.e., contact) the first hydrophobizing agent. The silica minute particles in the emulsion adsorb onto the surface of micelles (droplets) containing the first hydrophobizing agent. It is speculated that, as the first hydrophobizing agent becomes attached to the surface of the silica minute particles, whereby the silica minute particles are hydrophobized, the silica minute particles become more hydrophobic and move from the aqueous continuous phase of the emulsion into the droplets, so that the exposed part of the silica minute particles exposed at the surface of the droplets of the first hydrophobizing agent becomes less. Once polymerization is complete, the silica minute particles are fixed in the polymer particles formed by polymerization of the droplets containing the first hydrophobizing agent, whereby the silica-polymer composite minute particle is formed.

The second hydrophobizing agent can be used to adjust the degree of hydrophobicity of the exposed part of the silica minute particles exposed at the surface of the silica-polymer composite minute particle.

A co-monomer or crosslinking agent may be added to the reaction mixture in addition to the first hydrophobizing agent. The monomer may be added at the same time as or at a later time than the first hydrophobizing agent. The co-monomer copolymerizes with the first hydrophobizing agent to constitute the polymer part of the silica-polymer composite minute particle and is suitable for use in a toner additive. The co-monomer or crosslinking agent may be any as long as it is a monomer usable in a toner additive. For example, a divinyl terminated version of the first hydrophobizing agent (e.g., a silane compound substituted by a vinyl group) may be employed, or other well-known vinyl crosslinking agents, such as divinyl benzene and ethylene glycol dimethacrylate, may be employed. The addition of the crosslinking agent may be determined according to the degree of crosslinking in the polymer.

The degree of surface treatment of silica with the first hydrophobizing agent may be controlled by adjusting the pH and temperature of the initial solution. The rate of adsorption of the first hydrophobizing agent onto the silica minute particles (rate of formation of a siloxane bond between the surface and the hydrophobizing agent) may also be controlled by the choice of the leaving group on the silane; an ethoxy group hydrolyzes more slowly than a methoxy group.

The degree of surface treatment influences the amount of the surface of the silica minute particles exposed at the surface of the silica-polymer composite minute particle. When the first hydrophobizing agent is combined with an aqueous solution and stirred, the mixture forms an emulsion which is stabilized by the migration of the silica minute particles to the surface of the droplets of the first hydrophobizing agent. As silane hydrolyzes and adsorbs onto the silica surface, the originally hydrophilic surface becomes more hydrophobic and thus more compatible with the organic phase, gradually migrating from the aqueous side of the organic/aqueous interface to the organic side. Thus, controlling the degree of surface treatment of silica before polymerization also controls the amount of silica exposed at the surface of the resulting silica-polymer composite minute particle.

Alternatively, the silica-polymer composite minute particle may be produced according to the methods described in International Patent Application Publication No. 2008/142383 and Schmid, et al. (Advanced Materials, 2008, 20, 3331-3336; see also Fielding, et al., Langmuir, published online Jul. 21, 2011, DOI 10.1021/1a202066n). Briefly, the first hydrophobizing agent having a terminal or otherwise available hydroxy group is used to surface-treat colloidal silica minute particles using a well-known method described, for example, in International Patent Application Publication No. 2004/035474. While a dispersion composed of 3.5 to 5 mass % of the treated silica minute particles is stirred, a monomer is added thereto, so as to make a 10% monomer mixture. The mixture is degassed and heated to 60° C. A water-soluble radical initiator sufficient to adsorb onto the surface of the silica minute particles and have excess initiator is dissolved in the mixture, and polymerization is conducted for 24 hours. The mixture may be centrifuged, for example, at 3000 rpm to 6000 rpm for 30 minutes to remove excess silica minute particles together with the supernatant.

Alternatively, the silica-polymer composite minute particle may be produced according to the methods described in Sacanna, et al., (Langmuir 2007, 23, 9974-9982 and Langmuir 2007, 23, 10486-10492). Briefly, the silica minute particles are dispersed in 2M tetramethylammonium hydroxide or ammonium hydroxide and then redispersed in water. The first hydrophobizing agent, for example, 3-methacryloxypropyltrimethoxysilane, is added to the dispersion and polymerized with potassium persulfate.

The silica-polymer composite minute particle is typically round. The silica-polymer composite minute particle needs not be spherical but has a bumpy surface depending on the degree to which the silica minute particles are exposed at the surface of the silica-polymer composite minute particle. The silica-polymer composite minute particle has an aspect ratio of preferably 0.80 to 1.15 and far preferably 0.90 to 1.10.

The silica-polymer composite minute particle has a number average primary particle diameter of preferably 50 nm to 500 nm and far preferably 70 nm to 250 nm. The number average primary particle diameter within the above range produces a proper degree of the abrasion effect for the charging roller and an effect of suppressing wearing of the charging roller.

(Control Method of Particle Diameter of Silica-Polymer Composite Minute Particles)

Controlling the particle diameter of the droplets containing the first hydrophobizing agent added into the aqueous dispersion of silica minute particles as the materials for the silica-polymer composite minute particles also controls the number average primary particle diameter of the silica-polymer composite minute particles. For example, the string strength to mix and stir the aqueous dispersion of silica minute particles with the first hydrophobizing agent can control the number average primary particle diameter of the silica-polymer composite minute particles. Alternatively, changing the mass ratio $M_{MOM}/M_{silica}$ or the particle diameter of colloidal silica can control the number average primary particle diameter of the silica-polymer composite minute particles.

(Measurement Method of Number Average Primary Particle Diameter of Silica-Polymer Composite Minute Particles)

The number average primary particle diameter of the silica-polymer composite minute particles is measured as described below to be specific.

Pictures of the silica-polymer composite minute particles are taken with a scanning electron microscope at a magnification of 30,000, and the taken pictures are scanned with a scanner. Oxide particles present on the toner surface of the pictures are binarized with an image processor LUZEX® AP (from Nireco Co.). The horizontal Feret diameters of 100 silica-polymer composite minute particles are calculated, and the average value thereof is taken as the number average primary particle diameter. The horizontal Feret diameter is the length of a side of a bounding rectangle obtained by binarizing the image of the external additive, the side being parallel to the x axis.

<<Toner>>

The toner used in the image forming method of the present invention contains at least toner base particles and external additive minute particles, and the external additive minute particles contain the silica-polymer composite minute particles. The silica-polymer composite minute particles have a silicon atom abundance ratio which satisfies at least the following condition A. The silicon atom abundance ratio is obtained from the abundances of carbon atoms, oxygen atoms and silicon atoms present on the outermost surface and within 3 nm from the outermost surface in the depth direction of the silica-polymer composite minute particles measured with an x-ray photoelectron spectrometer.

$$15.0 \text{ atm } \% \leq \text{silicon atom abundance ratio } (\{Si/(C+O+Si)\}\times 100) \leq 30.0 \text{ atm } \% \quad \text{[Condition A]}$$

In the present invention, the "toner base particles" with an external additive added are referred to as "toner particles", and the assembly of the "toner particles" is referred to as the "toner".

<Explanation of Toner Base Particles>

The toner base particles contain a binder resin and optionally contain a colorant, a release agent, a charge control agent and the like. The toner base particles can be used as the toner particles as they are in general, but in the present invention, the toner base particles with the silica-polymer composite minute particles as an external additive added thereto are used as the toner particles.

(Binder Resin)

Where the toner base particles constituting the toner of the present invention are produced by the pulverization method, the dissolution/suspension method or the like, the binder resin constituting the toner base particles is exemplified by styrene-based polymers, acrylic polymers, styrene-acrylic copolymers, polyester, silicone polymers, olefinic polymers, amide-based polymers, and epoxy polymers.

Of these, preferred examples are styrene-based polymers, acrylic polymers, styrene-acrylic copolymers and polyester which have high meltability at low temperature, namely, sharp meltability. These may be used by themselves, or two or more types thereof may be mixed to use.

Where the toner base particles constituting the toner of the present invention are produced by the suspension polymerization method, the mini-emulsion polymerization aggregation method, the emulsion polymerization aggregation method or the like, a polymerizable monomer is used to produce each polymer constituting the toner. Examples thereof include various well-known polymerizable monomers such as a vinyl-based monomer. The polymerizable monomer used by preference is a mixture of components having ionic dissociation groups. Further, the polymerizable monomer may be a polyfunctional vinyl-based monomer to produce a binder resin having a crosslinked structure.

(Colorant)

The colorant constituting the toner base particles of the present invention may be a well-known inorganic or organic colorant. Usable examples of the colorant include carbon black, magnetic powder, various organic and inorganic pigments and dyes. The addition of the colorant is, to the toner base particles, 1 to 30 mass %, preferably 2 to 20 mass %.

(Release Agent)

The release agent may be added to the toner base particles of the present invention. As the release agent, wax is preferably used. Examples of the wax include: hydrocarbonic waxes such as a low molecular weight polyethylene wax, a low molecular weight polypropylene wax, a Fischer Tropsch wax, a microcrystalline wax, and a paraffin wax; and ester waxes such as a carnauba wax, a pentaerythritol-behenic acid ester, a behenyl behenate, and a behenyl citrate. These may be used by themselves, or two or more types thereof may be mixed to use.

It is preferable to use a wax having a melting point of 50° C. to 95° C. in order to certainly have low-temperature fixability and releasability of the toner. The content of the wax to the total amount of the binder resin is preferably 2 to 20 mass %, far preferably 3 to 18 mass % and still far preferably 4 to 15 mass %.

As the existence state of the wax in the toner base particles, it is preferable to form a domain in order to demonstrate the releasing effect. Forming a domain in the binder resin makes it easy to demonstrate their functions.

The domain diameter of the wax is preferably 300 nm to 2 μm. This range demonstrates the releasing effect well.

(Charge Control Agent)

The charge control agent may be added to the toner base particles as needed. As the charge control agent, various well-known charge control agents can be used.

As the charge control agent, various well-known compounds dispersible in aqueous media can be used. Examples thereof include nigrosine-based dyes, metal salt of naphthenic acid, metal salt of higher fatty acid, alkoxylated amine, quaternary ammonium salt compounds, azo-based metal complexes, and metal salicylate and metal complexes thereof.

The content of the charge control agent to the total amount of the binder resin is preferably 0.1 to 10 mass % and far preferably 0.5 to 5 mass %.

<Production Method of Toner Base Particles>

A production method of the toner base particles constituting the toner is not particularly limited, and examples thereof include the pulverization method, the suspension polymerization method, the emulsion polymerization aggregation method, the mini-emulsion polymerization aggregation method, the dissolution/suspension method, the polyester molecule elongation method and other well-known methods. The toner base particles constituting the toner are preferably produced with, of these methods, the emulsion polymerization aggregation method, in particular, the mini-emulsion polymerization aggregation method which associates (aggregates/fuses) polymer particles formed of mini-emulsion polymerization particles made to have a multistage polymerization structure by emulsion polymerization.

More specifically, for example, the mini-emulsion polymerization aggregation method is a method of: forming, with mechanical energy, oil droplets (10-1000 nm) of a polymerizable monomer solution which is composed of a release agent dissolved in a polymerizable monomer in an aqueous medium which is composed a surfactant having a concentration lower than the critical micelle concentration dissolved so as to prepare a dispersion; adding a water-soluble radical polymerization initiator into the dispersion so as to conduct radical polymerization to produce polymer minute particles; and associating (aggregating/fusing) the polymer minute particles so as to produce toner base particles. In this mini-emulsion polymerization aggregation method, alternatively or in addition to the water-soluble radical polymerization initiator, an oil-soluble radical polymerization initiator may be added into the monomer solution. The polymer minute particles may have a two- or more-layer structure composed of polymers different in composition. In this case, a method of adding a polymerizable monomer and a polymerization initiator into a dispersion of first polymer particles prepared by mini-emulsion polymerization treatment (first stage polymerization) according to a conventional manner and subjecting this system to polymerization treatment (second stage polymerization) may be employed. Additional polymerization treatment (third stage polymerization) may be conducted with addition of a polymerizable monomer and a polymerization initiator so that the polymer minute particles can have a three-layer structure.

One example of the method for producing the toner base particles employing the mini-emulsion polymerization aggregation method is specifically described below. The method includes the following steps of:

(1) a dissolving/dispersing step of dissolving or dispersing materials for toner base particles, such as a release agent and a charge control agent, according to need in a polymerizable monomer for a binder resin so as to prepare a polymerizable monomer solution;

(2) a polymerizing step of forming oil droplets of the polymerizable monomer solution in an aqueous medium so as to prepare an aqueous dispersion of polymer minute particles with mini-emulsion polymerization;

(3) a preparing step of dispersing a colorant in an aqueous medium so as to prepare an aqueous dispersion of colorant minute particles;

(4) an aggregating & fusing step of mixing the aqueous dispersion of polymer minute particles with the aqueous dispersion of colorant minute particles and forming aggregate particles through salting-out, aggregation and fusion in an aqueous medium;

(5) a ripening step of ripening the aggregate particles with thermal energy and regulating the shape so as to prepare an aqueous dispersion of toner base particles;

(6) a cooling step of cooling the aqueous dispersion of toner base particles;

(7) a filtering & washing step of subjecting the cooled aqueous dispersion of toner base particles to solid-liquid separation so as to separate the toner base particles therefrom and removing a surfactant and so forth from the toner base particles; and (8) a drying step of drying the washed toner base particles.

The "aqueous medium" means a medium composed of water as a main component (50 mass % or more). A component other than water is a water-soluble organic solvent. Examples thereof include methanol, ethanol, isopropanol, butanol, acetone, methyl ethyl ketone and tetrahydrofbran. Of these, particularly preferred are alcohol-based organic solvents which do not dissolve polymers, such as methanol, ethanol, isopropanol and butanol.

In the present invention, as described above, the aqueous dispersion of polymer minute particles constituting the binder rein and the aqueous dispersion of colorant minute particles are mixed, aggregated and fused so as to produce the toner base particles, and the toner base particles are used to produce the toner. The toner base particles may have a core-shell structure by using the toner base particles as the core and forming the shell on the surface of the core particles.

In this case, after the above (5) ripening step, an aqueous dispersion of polymer minute particles for the shell is added to and mixed with the aqueous dispersion of toner base particles, and the polymer minute particles for the shell are aggregated and fused on the surface of the toner base particles (core particles), whereby a shell layer is formed. Thus, the toner base particles having a core-shell structure can be produced.

Further, the toner base particles may be made to have a domain-matrix structure utilizing the above production method with multiple types of aqueous dispersions of polymer minute particles different in polymer physical properties, such as the glass transition point and the softening point, being aggregated and fused. The toner base particles having a domain-matrix structure can be produced by mixing, aggregating and fusing an aqueous dispersion of polymer minute particles constituting the domain, an aqueous dispersion of polymer minute particles constituting the matrix and an aqueous dispersion of colorant minute particles.

In the present invention, the domain-matrix structure is a structure in which a domain phase having a closed interface (boundary between phases) is present in a continuous matrix phase.

The toner base particles of the present invention preferably have the domain-matrix structure. The toner base particles having the domain-matrix structure have distribution of hardness (the hardness is different in parts) on the surface, and this hardness distribution properly adjusts adhesiveness to the silica-polymer composite minute particles and also properly adjusts the desorption amount of the silica-polymer composite minute particles, which serve as an abrasive, from the toner base particles.

<<Toner Base Particles Having Domain-Matrix Structure>>

Hereinafter, the toner base particles having the domain-matrix structure are detailed.

The toner base particles of the present invention preferably have the domain-matrix structure. The matrix preferably contains an acid group-containing vinyl-based polymer, and the domain preferably contains a polymer composed of a vinyl-based polymerization segment and a polyester polymerization segment binding to each other. The toner base particles having the domain-matrix structure can be produced by the mini-emulsion polymerization aggregation method. Hereinafter, the structures of the polymers and the structure of the toner base particles are described in order.

<Polymer Constituting Matrix>

The polymer constituting the matrix preferably contains an acid group-containing vinyl-based polymer, and is preferably an amorphous polymer containing an acid group-containing vinyl-based polymer. The acid group-containing vinyl-based polymer contains a polymer produced by polymerization of, at least, an acid group-containing monomer.

(Acid Group-Containing Monomer)

The acid group represents an ionic dissociation group exemplified by a carboxy group, a sulfonate group and a phosphate group. Examples of the carboxy group-containing monomer as the acid group-containing monomer include acrylic acid, methacrylic acid, maleic acid, itaconic acid, cinnamic acid, fumaric acid, maleic acid monoalkyl ester, and itaconic acid monoalkyl ester. Examples of the sulfonate group-containing monomer as the acid group-containing monomer include styrene sulfonic acid, allylsulfosuccinic acid, and 2-acrylamido-2-methylpropanesulfonic acid. Examples of the phosphate group-containing monomer as the acid group-containing monomer include acid phosphoxyethyl methacrylate.

Of these, acrylic acid and methacrylic acid are preferable in terms of surface polarity in the case where latex is formed in an aqueous medium by emulsion polymerization.

It is speculated that, in the present invention, the acid group-containing vinyl-based polymer makes polarity higher than styrene-acrylic modified polyester, and hence where the toner base particles are produced in an aqueous medium, the styrene-acrylic modified polyester having a low polarity can be easily present inside the toner, and both heat-resistant storage properties and low-temperature fixability can be achieved.

(Acrylic Ester Monomer)

The acid group-containing vinyl-based polymer of the present invention preferably contains a polymer produced by polymerization of an acrylic ester monomer in addition to the acid group-containing monomer.

Examples of the acrylic ester monomer include methyl acrylate, ethyl acrylate, isopropyl acrylate, n-butyl acrylate, t-butyl acrylate, isobutyl acrylate, n-octyl acrylate, and 2-ethylhexyl acrylate.

(Additional Vinyl-Based Monomer)

The acid group-containing vinyl-based polymer may use another vinyl-based monomer in addition to the acid group-containing monomer and the acrylic ester monomer. Examples thereof include: methacrylic ester derivatives such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrolene, methyl methacrylate, etyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; olefins such as ethylene, propylene and isobutylene; and acrylic acid or methacrylic acid derivatives such as acrylonitrile, methacrylonitrile and acrylamide.

These vinyl-based monomers may be used by themselves, or two or more types thereof may be mixed to use.

The content of the acid group-containing monomer constituting the acid group-containing vinyl-based polymer is preferably 4 to 10 mass %. This range allows the vinyl-based polymer to have a proper degree of polarity. Consequently, the acid group-containing vinyl-based polymer and the styrene-acrylic modified polyester do not blend but separate from each other, whereby the domain-matrix structure can be formed. In addition, the low-temperature fixability becomes excellent.

<Method of Conducting Polymerization for Acid Group-Containing Vinyl-Based Polymer>

As a method of conducting polymerization for the acid group-containing vinyl-based polymer, any conventional polymerization method can be employed. However, in the present invention, the emulsion polymerization method is preferable.

(Polymerization Initiator)

As a polymerization initiator used at a polymerizing step for the acid group-containing vinyl-based polymer, various well-known polymerization initiators can be suitably used. Examples thereof include: peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-hydroperoxide pertriphenylacetate, tert-butyl performate, tert-butyl peracetate, tert-butyl perbenzoate, tert-butyl perphenylacetate, tert-butyl permethoxyacetate and tert-butyl per-N-(3-tolyl)palmitic acid; and azo compounds such as 2,2'-azobis(2-aminodipropane)hydrochloride, 2,2'-azobis-(2-aminodipropane)nitrate, 1,1'-azobis (1-methylbutylonitrile-3-sodium sulfonate), 4,4'-azobis-4-cyanovalerate and poly(tetraethyleneglycol-2,2'-azobisisobutylate).

(Chain Transfer Agent)

At the polymerizing step for the acid group-containing vinyl-based polymer, a chain transfer agent conventionally used can be used in order to adjust the molecular weight of the vinyl-based polymer. The chain transfer agent is not particularly limited, and examples thereof include alkyl mercaptan and mercapto fatty acid ester. The chain transfer agent is preferably mixed with the materials for the polymer at the mixing step.

(Weight Average Molecular Weight)

The weight average molecular weight (Mw) of the acid group-containing vinyl-based polymer is preferably 7,500 to 100,000 and far preferably 10,000 to 50,000. The weight average molecular weight (Mw) thereof within this range achieves sufficient heat-resistant storage properties and also archives sufficient hot offset resistance.

(Measurement Method of Weight Average Molecular Weight (Mw))

The weight average molecular weight of the acid group-containing vinyl-based polymer is measured with a GPC (Gel Permeation Chromatograph).

A measurement sample is dissolved in tetrahydrofuran so as to be a concentration of 1 mg/mL. The dissolution is performed at room temperature for five minutes with an ultrasonic disperser. Next, the sample-dissolved solution is treated with a membrane filter having a pore size of 0.2 μm, and thereafter 10 μL of the sample-dissolved solution is poured into a GPC.

Measurement Conditions with GPC

Device: HLC-8220 (from Tosoh Co.)

Column: TSKguardcolumn+TSKgel SuperHZM-M 3 ren (from Tosoh Co.)

Column temperature: 40° C.

Solvent: tetrahydrofuran

Flow velocity: 0.2 mL/min

Detector: refractive index detector (RI detector)

In measuring the molecular weight of the sample, the molecular weight distribution of the sample is calculated using a calibration curve measured with monodisperse polystyrene standard particles. Ten pieces of polystyrene are used for measuring the calibration curve.

(Glass Transition Point (Tg))

The glass transition point (Tg) of the acid group-containing vinyl-based polymer is preferably 35° C. to 70° C. The grass transition point thereof within this range archives sufficient heat-resistant storage properties.

(Measurement Method of Glass Transition Point (Tg))

The glass transition point (Tg) of the acid group-containing vinyl-based polymer of the present invention can be measured with a differential scanning calorimeter "Diamond DSC" (from PerkinElmer Inc.).

The measurement procedure is as follows; precisely weight 4.5 mg to 5.0 mg of the polymer to the second decimal place; enclose the weighted polymer in an aluminum pan (KIT NO. 0219-0041); and place the aluminum pan on a sample holder. As a reference, an empty aluminum pan is used. The measurement conditions are a measurement temperature of 0° C. to 200° C., a temperature increase rate of 10° C./min, and a temperature decrease rate of 10° C./min. The temperature is controlled as follows: from temperature increase (Heat), to temperature decrease (Cool) and then to temperature increase (Heat). Analysis is made on the basis of data obtained during the second temperature increase (Heat).

The glass transition point is indicated by an intersection point of an extension of a baseline before rising of the first endothermic peak with a tangent indicating the maximum inclination between the rising part of the first endothermic peak and the peak.

<Polymer Constituting Domain>

The polymer constituting the domain preferably contains a polymer composed of a vinyl-based polymerization segment and a polyester polymerization segment binging to each other. The polymer composed of a vinyl-based polymerization segment and a polyester polymerization segment binging to each other (hereinafter may be referred to as "styrene-acrylic modified polyester") is preferably a polymer composed of a vinyl-based polymerization segment and a polyester polymerization segment binging to each other through a co-reactive monomer. The polyester polymerization segment may be crystalline polyester or amorphous polyester, preferably crystalline polyester. Other than the styrene-acrylic modified polyester, wax and the like may be added into the domain.

The content of the styrene-acrylic modified polyester in the toner base particles is preferably 3 to 30 mass %. The content thereof within this range allows the acid group-containing vinyl-based polymer constituting the matrix and the styrene-acrylic modified polyester constituting the domain not to be mixed but to separate from each other, thereby forming an excellent domain-matrix structure, and therefore achieves excellent heat-resistant storage properties and sufficient low-temperature fixability.

In the present invention, the "crystalline" polymer (polyester) means a polymer (polyester) not showing stepwise endothermic change but having a clear endothermic peak in differential scanning calorimetry (DSC). The clear endothermic peak means, to be specific, a peak having a full width at half maximum of the endothermic peak of 15° C. or less in the case of the measurement at a temperature increase rate of 10° C./min in differential scanning calorimetry (DSC).

Where the styrene-acrylic modified polyester is a crystalline polymer, the melting point thereof is preferably 50° C. to 95° C. and far preferably 55° C. to 85° C.

The melting point thereof within this range archives sufficient heat-resistant storage properties, sufficient low-temperature fixability and excellent hot offset resistance.

The melting point of the styrene-acrylic modified polyester can be mainly controlled by the monomer composition of the polyester polymerization segment.

In the present invention, the melting point of the styrene-acrylic modified polyester is a value obtained as follows.

The temperature of the styrene-acrylic modified polyester is measured with a differential scanning calorimeter "Diamond DSC" (from PerkinElmer Inc.) under the measurement conditions (Heat/Cool conditions) with which the first Heat process, the Cool process and the second Heat process are performed in this order. The first Heat process is a process in which the temperature is increased from 0° C. to 200° C. at a temperature increase rate of 10° C./min, the Cool process is a process in which the temperature is decreased from 200° C. to 0° C. at a temperature decrease rate of 10° C./min, and the second Heat process is a process in which the temperature is increased from 0° C. to 200° C. at a temperature increase rate of 10° C./min. On the basis of the DSC curve obtained by this measurement, the endothermic peak top temperature derived from the crystalline polyester in the first Heat process is taken as the melting point. The measurement procedure is as follows: enclose 3.0 mg of a measurement sample in an aluminum pan; and place the aluminum pan on a sample holder of the Diamond DSC. As a reference, an empty aluminum pan is used.

The weight average molecular weight (Mw) of the styrene-acrylic modified polyester measured by GPC (Gel Permeation Chromatography) is preferably 5,000 to 70,000.

[Vinyl-Based Polymerization Segment]

The vinyl-based polymerization segment constituting the styrene-acrylic modified polyester preferably contains a polymer produced by copolymerization of an acrylic monomer and an aromatic vinyl monomer and contains a segment produced by polymerization of an acrylic ester monomer as the acrylic monomer(s).

Examples of the acrylic ester monomer include methyl acrylate, ethyl acrylate, isopropyl acrylate, n-butyl acrylate, t-butyl acrylate, isobutyl acrylate, n-octyl acrylate and 2-ethylhexyl acrylate. These acrylic ester monomers may be used by themselves, or two or more types thereof may be mixed to use.

The vinyl-based polymerization segment constituting the styrene-acrylic modified polyester preferably contains the polymerization segment produced by polymerization of the acrylic ester monomer. The vinyl-based polymerization segment containing the polymerization segment produced by polymerization of the acrylic ester monomer makes the composition of the acid group-containing vinyl-based polymer and the composition of the vinyl-based polymerization segment of the styrene-acrylic modified polyester more similar to each other, which is preferable because it increases affinity.

The content of the vinyl-based polymerization segment in the styrene-acrylic modified polyester is preferably 5 to 30 mass %. The content thereof within this range produces an excellent domain-matrix structure, and allows polymer chains at an interface with the acid group-containing vinyl-based polymer to properly intertwine with one another, thereby increasing toner image intensity.

The vinyl-based polymerization segment constituting the styrene-acrylic modified polyester is made to be a copolymer by mixing the aromatic vinyl monomer with the acrylic ester monomer.

Examples of the aromatic vinyl monomer include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene, and derivatives thereof.

These aromatic vinyl monomers may be used by themselves, or two or more types thereof may be mixed to use.

(Polymerization Initiator)

As a polymerization initiator used in polymerization for the vinyl-based polymerization segment constituting the styrene-acrylic modified polyester, the polymerization initiator used in polymerization for the acid group-containing vinyl-based polymer can be used.

(Chain Transfer Agent)

In polymerization for the vinyl-based polymerization segment constituting the styrene-acrylic modified polyester, a chain transfer agent can be used in order to adjust the molecular weight of the vinyl-based polymerization segment. As the chain transfer agent, the chain transfer agent used in polymerization for the acid group-containing vinyl-based polymer can be used.

(Weight Average Molecular Weight)

The weight average molecular weight (Mw) of the vinyl-based polymerization segment constituting the styrene-acrylic modified polyester is preferably 1,000 to 20,000. The weight average molecular weight thereof within this range makes it easy to form an excellent domain-matrix structure.

[Polyester Polymerization Segment]

The polyester polymerization segment constituting the styrene-acrylic modified polyester of the present invention is preferably crystalline polyester produced by polycondensation reaction of a polycarboxylic acid compound and a polyhydric alcohol compound under the presence of a catalyst.

Where the polyester polymerization segment is a crystalline polymer, the melting point thereof is preferably 60° C. to 90° C., and the weight average molecular weight (Mw) thereof is preferably 2,000 to 40,000.

(Polycarboxylic Acid)

The polycarboxylic acid compound forming the polyester polymerization segment is a compound containing two or more carboxy groups in one molecular. Usable examples of the polycarboxylic acid compound include alkyl ester, acid anhydride and acid chloride of polycarboxylic acid compounds.

Specific examples of the polycarboxylic acid compound include: dicarboxylic acid such as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acetate, p-phenylene diacetate, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and dodecenylsuccinic acid; tri- or higher-valent-carboxylic acid such as trimellitic acid, pyromellitic acid, naphthalenetricarboxylic acid, naphthalenetetracarboxylic acid, pyrenetricarboxylic acid and pyrenetetracarboxylic acid. These may be mixed to use. In the present invention, aliphatic polycarboxylic acid is preferable as polycarboxylic acid forming crystalline polyester.

(Polyhydric Alcohol)

The polyhydric alcohol compound is a compound containing two or more hydroxy groups in one molecular. Examples of the polyhydric alcohol compound include: dihydric alcohols such as ethylene glycol, propylene glycol, butanediol, diethylene glycol, hexanediol, cyclohexanediol, octanediol, decanediol, dodecanediol, ethylene oxide adduct of bisphenol A and propylene oxide adduct of bisphenol A; trihydric or higher-hydric alcohols such as glycerin, pentaerythritol, hexamethylolmelamine, hexaethylolmelamine, tetramethylolbenzoguanamine and tetraethylolbenzoguanamine. In the present invention, aliphatic polyhydric alcohol is preferable as polyhydric alcohol forming crystalline polyester.

(Co-Reactive Monomer)

In the present invention, the co-reactive monomer is a monomer which makes the polyester polymerization segment and the vinyl-based polymerization segment bind to each other, and is a monomer containing, in a molecular, both a group selected from a hydroxy group, a carboxy group, an epoxy group, a primary amino group and a secondary amino group forming the polyester polymerization segment and an ethylenically unsaturated group forming the vinyl-based polymerization segment, preferably a monomer containing both a hydroxy group or a carboxy group and an ethylenically unsaturated group and far preferably a monomer containing both a carboxy group and an ethylenically unsaturated group, namely, vinyl-based carboxylic acid.

Examples of the co-reactive monomer include acrylic acid, methacrylic acid, fumaric acid and maleic acid, and hydroxyalkyl ester thereof (the number of carbon atoms: 1 to 3). Of these, preferred are acrylic acid, methacrylic acid and fumaric acid in terms of reactivity. Through this co-reactive monomer, the polyester polymerization segment and the vinyl-based polymerization segment bind to each other.

The used amount of the co-reactive monomer is, to 100 parts by mass of the total amount of the vinyl-based monomer, preferably 1 to 10 parts by mass and far preferably 4 to 8 parts by mass in order to increase low-temperature fixability, hot offset resistance and durability of the toner.

[Production Method of Styrene-Acrylic Modified Polyester]

As a production method of the styrene-acrylic modified polyester, an existing general scheme can be used. Representative examples thereof include the following three.

(1) conduct polymerization for the polyester polymerization segment in advance, and make the polyester polymerization segment react with the co-reactive monomer and further reach with the aromatic vinyl monomer and the (meth)acrylic ester-based monomer for forming the vinyl-based polymerization segment, thereby forming the styrene-acrylic modified polyester.

(2) conduct polymerization for the vinyl-based polymerization segment in advance, and make the vinyl-based polymerization segment react with the co-reactive monomer and further react with the polycarboxylic acid compound and the polyhydric alcohol compound for forming the polyester polymerization segment, thereby forming the styrene-acrylic modified polyester.

(3) conduct polymerization for each of the polyester polymerization segment and the vinyl-based polymerization segment in advance, and make the polyester polymerization segment and the vinyl-based polymerization segment react with the co-reactive monomer so as to make the segments bind to each other, thereby forming the styrene-acrylic modified polyester.

In the present invention, any of the above production methods can be used. However, the above (2) of conducting polymerization for the vinyl-based polymerization segment in advance, and making the vinyl-based polymerization segment reach with the co-reactive monomer and further react with the polycarboxylic acid compound and the polyhydric alcohol compound for forming the polyester polymerization segment, thereby forming the styrene-acrylic modified polyester, is preferable.

More specifically, it is preferable to mix the polycarboxylic acid compound and the polyhydric alcohol compound for forming the polyester polymerization segment, the vinyl-based monomer for forming the vinyl-based polymerization segment and the co-reactive monomer with one another; add a polymerization initiator thereto to conduct addition polymerization of the vinyl-based monomer and the co-reactive monomer so as to form the vinyl-based polymerization segment; and then add an esterification catalyst so as to conduct polycondensation reaction.

As a ratio of the polyhydric alcohol compound to the polycarboxylic acid compound in polycondensation reaction of the polyester polymerization segment, the equivalent ratio "the hydroxyl group [OH] of the polyhydric alcohol compound/the carboxy group [COOH] of the polycarboxylic acid compound" is preferably 1.5/1 to 1/1.5 and far preferably 1.2/1 to 1/1.2.

(Catalyst)

As the catalyst for synthesizing the polyester polymerization segment, various well-known catalysts can be used.

Examples of the esterification catalyst include: tin compounds such as dibutyltin oxide and 2-ethylhexanoic acid tin (II); and titanium compounds such as titanium diisopropylate bis(triethanolaminate), and examples of an esterification catalytic promoter include gallic acid. The used amount of the esterification catalyst is, to 100 parts by mass of the total amount of the polyhydric alcohol compound, the polycarboxylic acid compound and the co-reactive monomer, preferably 0.01 to 1.5 parts by mass and far preferably 0.1 to 1.0 parts by mass. The used amount of the esterification catalytic promoter is, to 100 parts by mass of the total amount of the polyhydric alcohol compound, the polycarboxylic acid compound and the co-reactive monomer, preferably 0.001 to 0.5 parts by mass and far preferably 0.01 to 0.1 parts by mass.

<<Production Method of Toner Base Particles Having Domain-Matrix Structure>>

The toner base particles having the domain-matrix structure can be produced by aggregating and fusing an aqueous dispersion of acid group-containing vinyl-based polymer minute particles, an aqueous dispersion of styrene-acrylic modified polyester minute particles and an aqueous dispersion of colorant minute particles.

<Preparing Step of Aqueous Dispersion of Acid Group-Containing Vinyl-Based Polymer Minute Particles>

The aqueous dispersion of acid group-containing vinyl-based polymer minute particles is, as described above, preferably prepared by the emulsion polymerization method or the mini-emulsion polymerization method.

The polymer minute particles formed at the polymerizing step for the acid group-containing vinyl-based polymer constituting the toner base particles may have a single-layer structure composed of a polymer or, as described above, a two- or three-layer structure composed of polymers different in composition.

The toner base particles having these kinds of structure allow free choice of polymer physical characteristics such as the weight average molecular weight and the glass transition point of the polymer of each layer, and consequently can control characteristics of the toner base particles according to the purpose.

Where a surfactant is used at the polymerizing step for the acid group-containing vinyl-based polymer, for example, the following surfactants can be used. As to a polymerization initiator and a chain transfer agent, the above-mentioned ones can be used.

(Surfactant)

It is preferable that a dispersion stabilizer be added into an aqueous medium in order to prevent the dispersed minute particles from aggregating.

As the dispersion stabilizer, various well-known surfactants such as a cationic surfactant, an anionic surfactant and a nonionic surfactant can be used.

Examples of the cationic surfactant include dodecyl ammonium bromide, dodecyl trimethyl ammonium bromide, dodecyl pyridinium chloride, dodecyl pyridinium bromide and hexadecyl trimethyl ammonium bromide.

Examples of the nonionic surfactant include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether and monodecanoyl sucrose.

Examples of the anionic surfactant include: aliphatic soaps such as sodium stearate and sodium laurate; sodium lauryl sulfate; sodium dodecylbenzene sulfonate; and sodium polyoxyethylene (2) lauryl ether sulfate.

These surfactants may be used by themselves, or two or more types thereof may be mixed to use.

The average particle diameter of the polymer minute particles produced at the polymerizing step for the binder resin is preferably, for example, 50 nm to 500 nm in volume-based median diameter.

The volume-based median diameter thereof can be measured with a particle diameter analyzer "UPA-150" (from MicrotracBEL Corp.).

<Preparing Step of Aqueous Dispersion of Styrene-Acrylic Modified Polyester Minute Particles>

In the present invention, as a method of preparing the dispersion of styrene-acrylic modified polyester minute particles, any of the following methods can be used: a method of mechanically pulverizing the styrene-acrylic modified polyester and dispersing the resulting product with a surfactant in an aqueous medium; a method of pouring and dispersing in an aqueous medium a solution composed of the styrene-acrylic modified polyester dissolved in an organic solvent so as to form an aqueous medium dispersion; a method of mixing the styrene-acrylic modified polyester in the melted state with an aqueous medium and mechanically dispersing the resulting product so as to form an aqueous medium dispersion; and the phase inversion emulsification method.

As the surfactant, any of the above-mentioned surfactants can be used.

The average particle diameter of the styrene-acrylic modified polyester minute particles produced at the preparing step of the aqueous dispersion of styrene-acrylic modified polyester minute particles is preferably, for example, 80 nm to 250 nm in volume-based median diameter.

The volume-based median diameter thereof can be measured with a particle diameter analyzer "UPA-150" (from MicrotracBEL Corp.).

<Preparing Step of Aqueous Dispersion of Colorant Minute Particles>

The aqueous dispersion of colorant minute particles can be prepared by dispersing a colorant in an aqueous medium. The colorant is preferably dispersed in a state in which the concentration of a surfactant is the critical micelle concentration (CMC) or more in the aqueous medium so that the colorant can be uniformly dispersed. As a disperser used for dispersing the colorant, various well-known dispersers can be used.

As the surfactant, for example, any of the above-mentioned surfactants can be used.

The dispersion diameter of the colorant minute particles in the aqueous dispersion of colorant minute particles prepared at the preparing step of the aqueous dispersion of colorant minute particles is preferably 10 nm to 300 nm in volume-based median diameter.

The volume-based median diameter of the colorant minute particles in the aqueous dispersion of colorant minute particles can be measured with an electrophoretic light scattering photometer "ELS-800" (from Otsuka Electronics Co., Ltd.).

Where the surfactant is used at the preparing step of the aqueous dispersion of colorant minute particles, for example, the surfactants cited as examples of the surfactant used at each of the preparing steps of the aqueous dispersions of polymer minute particles can be used.

<Producing Step of Toner Base Particles (Aggregating & Fusing Step)>

The toner base particles having the domain-matrix structure can be produced by mixing the aqueous dispersion of acid group-containing vinyl-based polymer minute particles constituting the matrix, the aqueous dispersion of styrene-acrylic modified polyester minute particles constituting the domain and the aqueous dispersion of colorant minute particles with one another, and aggregating and fusing these.

To the toner base particles of the present invention, an internal additive exemplified by as wax and a charge control agent may be added. The internal additive may be introduced into toner particles by preparing a dispersion of internal additive minute particles composed of only the internal additive and aggregating the internal additive minute particles together with the polymer minute particles and the colorant minute particles at the forming step of the toner base particles, but preferably introduced into toner particles by introducing the internal additive in advance at the polymerizing step for the binder resin.

(Particle Diameter of Toner Base Particles)

The particle diameter of the toner base particles constituting the toner particles used in the image forming method of the present invention is preferably 3 μm to 8 μm in number average particle diameter. Where the toner base particles are formed by the polymerization method, the particle diameter can be controlled by controlling the concentration of a flocculant, the addition of an organic solvent, the fusing time and/or the compositions of polymers in the above-described production method of toner. The number average particle diameter thereof within the range from 3 μm to 8 μm achieves reproducibility of thin lines and high quality of picture images and also achieves reduction of toner consumption as compared with the case where toner having a large particle diameter is used.

(Measurement of Particle Diameter of Toner Base Particles)

The volume-based median diameter ($D_{50}$) of the toner base particles can be measured and calculated with, for example, a device constituted of "Multisizer 3" (from Beckman Coulter, Inc.) connected with a computer system for data processing. The measurement procedure is as follows: well disperse 0.02 g of the toner base particles in 20 mL of a surfactant solution (e.g., a surfactant solution composed of a surfactant component-containing neutral detergent diluted 10 times with pure water for dispersing the toner base particles) and then perform ultrasonic dispersion for one minute, so as to prepare a toner base particle dispersion; pour this toner base particle dispersion into a beaker containing ISOTON II (from Beckman Coulter, Inc.) in a sample stand with a pipette until the measurement concentration reaches 5% to 10%; set the counter of the measurement device to 25,000; and perform the measurement. The aperture diameter of the Multisizer 3 is 100 μm. The measurement range of 1 μm to 30 μm is divided into 256 segments, and the frequency is calculated. The particle diameter at 50% in volume-based cumulative fractions from the largest is taken as the volume-based median diameter ($D_{50}$).

(Measurement of Average Roundness of Toner Base Particles)

The average roundness of the toner base particles used in the present invention is preferably 0.850 to 0.990. The average roundness of the toner base particles is a value obtained with a flow particle image analyzer "FPIA-2100" (from Sysmex Co.). More specifically, the average roundness thereof is measured as follows: wet the toner base particles with a surfactant solution; perform ultrasonic dispersion for one minute; after the dispersion, perform the measurement with the "FPIA-2100" in an HPF (High Power Field, high magnification imaging) mode at a proper concentration of a HPF detection number of 3,000 to 10,000 particles as a measurement condition. This range provides reproducible measurement values. The roundness is calculated by the following Equation (1).

Roundness=(Circumference of Circle Having Projected Area the same as Projected Area of Particle Image)/(Circumference of Projected Particle Image) [Equation (1)]

The average roundness is an arithmetic mean value obtained by adding up values of the roundness of the particles and dividing the sum by the number of the particles measured.

The particle diameter and the average roundness of the toner particles can be measured in the same way as those of the toner base particles.

<<Production of Toner Particles>>

<Addition of Silica-Polymer Composite Minute Particles>

The content of the silica-polymer composite minute particles of the present invention is, to 100 parts by mass of the toner base particles, preferably 0.3 to 5.0 parts by mass. This range is preferable in terms of charge characteristic and fluidity of the toner and also can demonstrate an effect of increasing wear resistance of the charging roller.

<Additional External Additive Minute Particles>

The external additive minute particles contained in the toner used in the image forming method of the present invention are not limited to the specific external additive minute particles described above, and hence additional external additive minute particles may be used together. Where additional external additive minute particles are used, it is preferable that, to 100 parts by mass of the toner base particles, 0.1 to 10 parts by mass of the all external additive minute particles be added, and it is far preferable that, of which, the specific external additive minute particles be 0.3 to 5.0 parts by mass as described above.

Usable examples of the additional external additive minute particles include various inorganic minute particles, organic minute particles and lubricants. Examples of the inorganic minute particles used by preference include minute particles of inorganic oxides such as silica, titania and alumina. It is preferable that these inorganic minute particles be hydrophobized with a silane coupling agent, a titanium coupling agent or the like. As the organic minute particles, spherical ones having a number average primary particle diameter of about 10 nm to 2,000 nm are usable. Usable examples of the organic minute particles include polymers such as polystyrene, polymethyl methacrylate and styrene-methyl methacrylate copolymers. As the additional external additive minute particles, various ones may be mixed to use. Where the additional external additive minute particles are used, the silica-polymer composite minute particles of the present invention serve as a spacer too, and have an effect of preventing the minute particles of the additional external additive, for example, silica or titania, from being buried in the toner base particles by being stirred in a development device.

<Adding of External Additive Minute Particles>

The toner is produced by adding and mixing the external additive minute particles including the silica-polymer composite minute particles to and with the toner base particles. As a mixing device used in adding the external additive minute particles thereto, a mechanical mixing device such as a Henschel mixer or a coffee mill can be used.

<<Developer>>

The toner used in the image forming method of the present invention may be used as a magnetic or nonmagnetic one-component developer or as a two-component developer composed of the toner mixed with various well-known carriers.

The volume average particle diameter of a carrier(s) is preferably 20 μm to 100 μm and far preferably 25 μm to 80 μm. The volume average particle diameter of the carrier can be measured with, for example, a laser diffraction particle size analyzer "HELOS" (from Sumpatec Inc.) provided with a wet-type disperser.

The developer composed of the toner containing the specific external additive minute particles is used in the image forming method with an image forming apparatus provided with the charging roller detailed below.

<<Image Forming Apparatus>>

Figure 2:
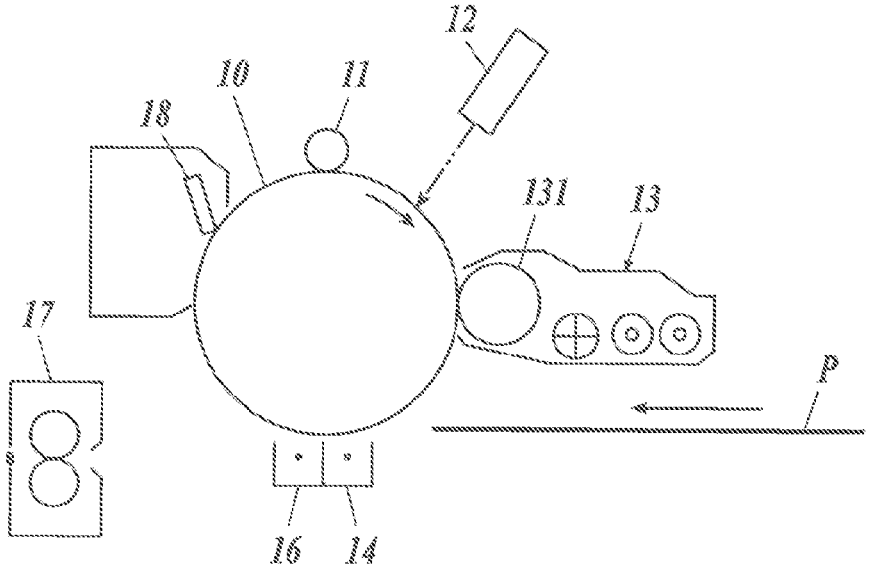
FIG. 2 is a schematic view showing an example of the configuration of an image forming apparatus employing an image forming method of the present invention.

FIG. 2 is a schematic view showing an example of the configuration of an image forming apparatus employing the image forming method of the present invention. The image forming apparatus includes: a photosensitive drum 10 as an electrostatic latent image holder having a photosensitive layer and being rotated clockwise by power from a not-shown driving source; a below-described charging roller 11 uniformly applying electrical potential to the surface of the photosensitive drum 10; an exposing unit 12 performing scanning in parallel to a rotation axis of the photosensitive drum 10 with a polygon mirror or the like and performing image exposure on the uniformly-charged surface of the photosensitive drum 10 on the basis of image data so as to form an electrostatic latent image thereon; and a developing unit 13 provided with a rotational developing sleeve 131 and carrying toner held on the developing sleeve 131 to the surface of the photosensitive drum 10. In FIG. 2, the "18" represents a cleaning unit removing toner remaining on the photosensitive drum 10 after transfer.

In this kind of image forming apparatus, a toner image formed on the photosensitive drum 10 is transferred by a transfering unit 14 onto an image support P timely carried thereto, the image support P having the toner image is released from the photosensitive drum 10 by a releasing unit 16, and the toner image is fixed onto the image support P by a fixing unit 17, so that an image is formed.

<Charging Roller>

Figure 3:
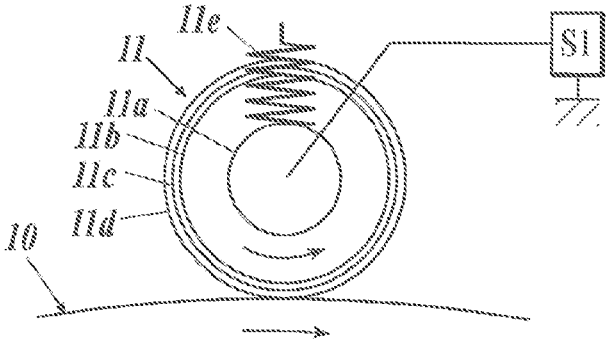
FIG. 3 is a schematic view showing an example of the configuration of a charging roller used in the image forming method of the present invention.

The charging roller 11 includes, as shown in FIG. 3, a core bar 11*a*, an elastic layer 11*b*, a resistance control layer 11*c*, a surface layer 11*d* and a pressure spring 11*e*, and is configured in such a way that the core bar 11*a*, the elastic layer 11*b*, the resistance control layer 11*c* and the surface layer 11*d* are disposed in the order named. The elastic layer 11*b* is for reducing charging noise and for producing uniform adhesiveness to the photosensitive drum 10 by applying elasticity thereto. The resistance control layer 11*c* is provided as needed for the charging roller 11 to have highly uniform electric resistance as a whole. The surface layer 11*d* is for preventing leakage from occurring even if there is a defect such as a pinhole on the photosensitive drum 10. The charging roller 11 is biased toward the photosensitive drum 10 by the pressure spring 11*e* so as to be pressed against and contact the surface of the photosensitive drum 10 with a predetermined pressure and form a charging nip part, and rotates as the photosensitive drum 10 rotates.

The core bar 11*a* is made of metal such as iron, copper, stainless steel, aluminum or nickel with or without plating on the surface of the metal for rust-prevention and scratch resistance with no reduction of conductivity. The outer diameter of the core bar 11*a* is, for example, 3 mm to 20 mm.

The elastic layer 11*b* is made of a conductive material which is composed of a conductive agent added into an elastic material such as rubber. Examples of the conductive agent include: conductive minute particles of carbon black and carbon graphite; and conductive salt minute particles of alkali metal salt and ammonium salt. Examples of the elastic material include: natural rubber; synthetic rubbers such as ethylene propylene diene methylene rubber (EPDM), styrene-butadiene rubber (SBR), silicon rubber, urethane rubber, epichlorohydrin rubber, isoprene rubber (IR), butadiene rubber (BR), nitrile-butadiene rubber (NBD) and chloroprene rubber (CR); polymers such as polyamide, polyurethane, silicone polymer and fluoride-based polymer; and foams such as foam sponge. The degree of elasticity can be adjusted by adding a process oil, a plasticizer or the like into the elastic material.

The elastic layer 11*b* has a volume resistivity of preferably $1\times10^{1}$ Ω·cm to $1\times10^{10}$ Ω·cm. Further, the elastic layer 11*b* has a thickness of preferably 500 μm to 5,000 μm and far preferably 500 μm to 3,000 μm. The volume resistivity of the elastic layer 11*b* is a value determined in conformity to JIS K 6911.

The surface layer 11*d* is provided to prevent bleed-out of the plasticizer or the like in the elastic layer 11*b* to the surface of the charging roller 11, to provide slippage and smoothness for the surface of the charging roller 11, and/or to prevent leakage from occurring even if there is a defect such as a pinhole on the photosensitive drum 10. The surface layer 11*d* is provided by coating the layer 11*b* (or 11*c*) with a material having a proper degree of conductivity or by covering the layer 11*b* (or 11*c*) with a tube having a proper degree of conductivity.

Where the surface layer 11*d* is provided by coating the layer 11*b* (or 11*c*) with the conductive material, examples of the material include materials composed of, into any of base materials which are exemplified by: polymers such as polyamide, polyurethane, acrylic polymer, fluoride-based polymer and silicone polymer; and rubbers such as epichlorohydrin rubber, urethane rubber, chloroprene rubber and acrylonitrile-based rubber, any of conductive agents which are exemplified by: conductive minute particles of carbon black and carbon graphite; and conductive metal oxide minute particles of conductive titanium oxide, conductive zinc oxide and conductive tin oxide is added. Examples of the coating method include dip coating, roll coating and spray coating.

Where the surface layer 11*d* is provided by covering the layer 11*b* (or 11*c*) with the conductive tube, examples of the tube include tubes composed of, to any of nylon 12, tetrafluoroetylene-perfluoroalkylvinylether copolymer (PFA), polyvinylidene fluoride (PVDF), tetrafluoroethylene-hexafluoropropylene copolymer (FEP), and thermoplastic elastomers of polystyrene, polyolefin, polyvinyl chloride, polyurethane, polyester and polyamide, any of the above conductive agents is added. This tube may be or may not be heat shrinkable.

The surface layer 11*d* has a volume resistivity of preferably $1\times10^{1}$ Ω·cm to $1\times10^{8}$ Ω·cm and far preferably $1\times10^{1}$ Ω·cm to $1\times10^{5}$ Ω·cm. Further, the surface layer 11*d* has a thickness of preferably 0.5 μm to 100 μm, far preferably 1 μm to 50 μm and still far preferably 1 μm to 20 μm.

The volume resistivity of the surface layer 11*d* is a value determined in conformity to JIS K 6911. Further, the surface layer 11*d* has a surface roughness Rz of preferably 1 μm to 30 μm, far preferably 2 μm to 20 μm and still far preferably 5 μm to 10 μm. The "Rz" represents a ten-point average surface roughness specified in JIS B0601 (1994).

The resistance control layer 11*c* is provided for the charging roller 11 to have uniform electric resistance as a whole, but not essential. The resistance control layer 11*c* is provided by coating the layer 11*b* with a material having a proper degree of conductivity or by covering the layer 11*b* with a tube having a proper degree of conductivity.

Examples of the material for the resistance control layer 11*c* include materials composed of, into any of base materials which are exemplified by: polymers such as polyamide, polyurethane, fluoride-based polymer and silicone polymer; and rubbers such as epichlorohydrin rubber, urethane rubber, chloroprene rubber and acrylonitrile-based rubber, any of conductive agents which are exemplified by: conductive minute particles of carbon black and carbon graphite; conductive metal oxide minute particles of conductive titanium oxide, conductive zinc oxide and conductive tin oxide; and conductive salt minute particles of alkali metal salt and ammonium salt is added.

The resistance control layer 11*c* has a volume resistivity of preferably $1\times10^{-2}$ Ω·cm to $1\times10^{14}$ Ω·cm and far preferably $1\times10^{1}$ Ω·cm to $1\times10^{10}$ Ω·cm. Further, the resistance control layer 11*c* has a thickness of preferably 0.5 to 100 μm, far preferably 1 to 50 μm and still far preferably 1 to 20 μm. The volume resistivity of the resistance control layer 11*c* is a value determined in conformity to JIS K 6911.

In the above-described charging roller 11, to the core bar 11*a* thereof, a charging bias voltage is applied from a power source S1, so that the surface of the photosensitive drum 10 is charged to be predetermined electric potential of predetermined polarity. The charging bias voltage may be an oscillation voltage formed of an AC voltage (Vac) superposed on a DC voltage (Vdc).

The charging conditions with the charging roller shown in FIG. 3 are, for example, a DC voltage (Vdc) of −500 V and an AC voltage (Vac) of a sine wave having a frequency of 1000 Hz and a peak-to-peak voltage of 1300 V, the DC voltage (Vdc) and the AC voltage (Vac) forming the charging bias voltage. By application of this charging bias voltage, the surface of the photosensitive drum 10 is uniformly charged to be −500 V. The length of the charging roller 11 is based on the length of the photosensitive drum 10 in the longer direction and may be 320 mm.

<Image Support>

The image support P used in the image forming method of the present invention is an image support to support/hold toner images thereon, and examples thereof include but are not limited to plain paper from thin paper to thick paper, high-quality paper, coated printing paper such as art paper and coated paper, commercially-available Japanese paper and post cards, plastic films for OHP and cloth.

As described above, according to the present invention, there can be provided an image forming method employing a system of charging with a roller (i.e. using a charging roller), the image forming method being capable of forming over a long period high-quality images without image defects caused by non-uniform charging.

Although appearance mechanism of the effects of the present invention and action mechanism thereof are not clear yet, speculation thereon is made as follows.

In the image forming method of the present invention, the toner contains minute particles of a specific external additive (i.e. specific external additive minute particles), and the specific external additive minute particles abrade and remove the toner and the components of the toner adhering to the charging roller, thereby preventing dirt from being accumulated on the charging roller. Further, the specific external additive minute particles do not damage the charging roller, thereby being capable of stably forming high-quality images over a long period.

Where a generally known abrasive, such as silica, titania, calcium titanate or strontium titanate, is used as the external additive minute particles contained in the toner, although the external additive minute particles serve as an abrasive and can prevent adhesive matters from adhering to the charging roller, the minute particles damage the charging roller, thereby being incapable of stably forming high-quality images over a long period.

In the present invention, however, the specific external additive minute particles are contained in the toner, and the specific external additive minute particles demonstrate the effect of preventing dirt with the toner from being accumulated on the charging roller and also do not damage the charging roller. It is speculated that the reason why the charging roller is not damaged is that while the silica part of the silica-polymer composite minute particles serves as an abrasive, the polymer part thereof absorbs excessive pressure.

An embodiment of the present invention is detailed above. However, the present invention is not limited to the above embodiment and hence can be variously modified.

EXAMPLES

Hereinafter, the present invention is detailed with Examples. However, the present invention is not limited thereto. Note that "parts" and "percent (or %)" used in Examples stand for "parts by mass" and "mass % (percent by mass)", respectively, unless otherwise specified.

<<Production of Silica-Polymer Composite Minute Particles>>

<Synthesis of Silica-Polymer Composite Minute Particles 1>

Into a 250 mL four-neck round-bottom flask fitted with an overhead stirring motor, a capacitor and a thermocouple, 18.7 g of a Ludox AS-40 colloidal silica dispersion (from W.R. Grace & Co.) (number average primary particle diameter: 25 nm, BET SA: 126 $m^2/g$, pH: 9.1, silica concentration: 40 mass %), 125 mL of deionized water, and 15.0 g of methacryloxypropyltrimethoxysilane (CAS #2530-85-0, Mw=248.3) as the first hydrophobizing agent were fed. The mass ratio $M_{MOM}/M_{silica}$ was 2.0.

The temperature of the reaction mixture was increased to 65° C., and nitrogen gas was bubbled through the mixture for 30 minutes while the mixture was stirred at 120 rpm. Three hours later, 0.16 g (methacryloxypropyltrimethoxysilane: 1 mass % or less) of 2,2'-azobisisobutyronitrile (abbr. AIBN, CAS #78-67-1, Mw=164.2) as a radical polymerization initiator dissolved in 10 mL of ethanol was added, and the temperature was increased to 75° C.

Thereafter, radical polymerization was conducted for five hours, and subsequently 3 mL (2.3 g, 0.014 mol) of 1,1,1,3,3,3-hexamethyldisilazane (HMDS) was added to the mixture as the second hydrophobizing agent. The reaction was conducted for another three hours. The final mixture was filtered through a 170 mesh sieve to remove coarse aggregate particles, and the dispersion was dried at 120° C. in a Pyrex® tray overnight. A white powdery solid was collected the next day and milled using an IKA M 20 Universal mill. Thus, silica-polymer composite minute particles 1 were produced. The silica-polymer composite minute particles 1 had a number average primary particle diameter of 106 nm and a silicon atom abundance ratio of 24.8 atm %. The number average primary particle diameter of the silica-polymer composite minute particles 1 was, as described above, measured as follows: pictures of the silica-polymer composite minute particles were taken with a scanning electron microscope at a magnification of 30,000; and the taken pictures were scanned with a scanner and analyzed with an image processor LUZEX® AP (from Nireco Co.). The silicon atom abundance ratio was measured with an x-ray photoelectron spectrometer "K-Alpha" (from Thermo Fisher Scientific K.K.).

<Synthesis of Silica-Polymer Composite Minute Particles 2 to 9>

Silica-polymer composite minute particles 2 to 9 different in number average primary particle diameter were synthesized in the same way as the silica-polymer composite minute particles 1, except that the number average primary particle diameter of colloidal silica and the mass ratio $M_{MOM}/M_{silica}$ were changed to those shown in TABLE 1.

<Synthesis of Silica-Polymer Composite Minute Particles 10 and 11>

Silica-polymer composite minute particles 10 were synthesized in the same way as the silica-polymer composite minute particles 1, except for using (3-acryloxypropyl) trimethoxysilane (CAS #4369-14-6, Mw=234.3) as the first hydrophobizing agent and isobutyltrimethoxysilane as the second hydrophobizing agent. Silica-polymer composite minute particles 11 were synthesized in the same way as the silica-polymer composite minute particles 1, except for using methacryloxypropyltriethoxysilane (CAS #21142-29-0, Mw=290.4) as the first hydrophobizing agent and octyltriethoxysilane as the second hydrophobizing agent.

Production of Toner

1. Producing Example of Toner Base Particles (1) (Producing Example of Toner Base Particles Containing Styrene-Acrylic Resin (Not Containing Other Resins))

(1) Producing Example of Polymer Minute Particle Dispersion (1)

First Stage Polymerization

Into a reaction vessel fitted with a stirring device, a temperature sensor, a cooling tube and a nitrogen introducing device, a solution composed of 8 parts by mass of sodium dodecyl sulfate dissolved in 3000 parts by mass of deionized water was fed, and the internal temperature was increased to 80° C. while the solution was stirred at a stirring speed of 230 rpm under a nitrogen gas stream. After the temperature increase, a solution composed of 10 parts by mass of potassium persulfate dissolved in 200 parts by mass of deionized water was added; the solution temperature was adjusted to 80° C. again; a polymerizable monomer solution composed of 480 parts by mass of styrene, 250 parts by mass of n-butyl acrylate, 68.0 parts by mass of methacrylic acid and 16.0 parts by mass of n-octyl-3-mercaptopropionate was dripped taking one hour; and then polymerization was

TABLE 1

| | MATERIALS | | | | SILICA-POLYMER COMPOSITE PARTICLES | |
|---|---|---|---|---|---|---|
| SILICA-POLYMER COMPOSITE PARTICLES No. | COLLOIDAL SILICA NUMBER AVERAGE PRIMARY PARTICLE DIAMETER (nm) | FIRST HYDROPHOBIZING AGENT | $M_{MON}/M_{silica}$ | SECOND HYDROPHOBIZING AGENT | NUMBER AVERAGE PRIMARY PARTICLE DIAMETER (nm) | SILICON ATOM ABUNDANCE RATIO (atm %) |
| SILICA-POLYMER COMPOSITE PARTICLES 1 | 25 | METHACRYL OXYPROPYLTRIMETHOXYSILANE | 2.0 | HEXAMETHYL DISILAZANE | 106 | 24.8 |
| SILICA-POLYMER COMPOSITE PARTICLES 2 | 25 | METHACRYL OXYPROPYLTRIMETHOXYSILANE | 1.2 | HEXAMETHYL DISILAZANE | 50 | 25.1 |
| SILICA-POLYMER COMPOSITE PARTICLES 3 | 25 | METHACRYL OXYPROPYLTRIMETHOXYSILANE | 16.0 | HEXAMETHYL DISILAZANE | 500 | 25.4 |
| SILICA-POLYMER COMPOSITE PARTICLES 4 | 25 | METHACRYL OXYPROPYLTRIMETHOXYSILANE | 1.0 | HEXAMETHYL DISILAZANE | 45 | 24.6 |
| SILICA-POLYMER COMPOSITE PARTICLES 5 | 25 | METHACRYL OXYPROPYLTRIMETHOXYSILANE | 18.0 | HEXAMETHYL DISILAZANE | 550 | 24.9 |
| SILICA-POLYMER COMPOSITE PARTICLES 6 | 12 | METHACRYL OXYPROPYLTRIMETHOXYSILANE | 2.0 | HEXAMETHYL DISILAZANE | 113 | 15.2 |
| SILICA-POLYMER COMPOSITE PARTICLES 7 | 40 | METHACRYL OXYPROPYLTRIMETHOXYSILANE | 2.0 | HEXAMETHYL DISILAZANE | 95 | 29.7 |
| SILICA-POLYMER COMPOSITE PARTICLES 8 | 7 | METHACRYL OXYPROPYLTRIMETHOXYSILANE | 2.0 | HEXAMETHYL DISILAZANE | 121 | 13.8 |
| SILICA-POLYMER COMPOSITE PARTICLES 9 | 55 | METHACRYL OXYPROPYLTRIMETHOXYSILANE | 2.0 | HEXAMETHYL DISILAZANE | 85 | 31.5 |
| SILICA-POLYMER COMPOSITE PARTICLES 10 | 25 | (3-ACRYLOXYPROPYL) TRIMETHOXYSILANE | 2.0 | ISOBUTYL TRIMETHOXY SILANE | 108 | 25.3 |
| SILICA-POLYMER COMPOSITE PARTICLES 11 | 25 | METHACRYL OXYPROPYLTRIETHOXYSILANE | 2.0 | OCTYL TRIETHOXY SILANE | 103 | 25.6 |

conducted through heating and stirring at 80° C. for two hours. Thus, a polymer minute particle dispersion (1H) containing polymer minute particles (1 h) was prepared.

(Second Stage Polymerization)

Into a reaction vessel fitted with a stirring device, a temperature sensor, a cooling tube and a nitrogen introducing device, a solution composed of 7 parts by mass of polyoxyethylene-2-dodecyl ether sodium sulfate dissolved in 800 parts by mass of deionized water was fed. After the solution was heated to 98° C., 260 parts by mass of the polymer minute particle dispersion (1H) and a polymerizable monomer solution composed of 245 parts by mass of styrene, 120 parts by mass of n-butyl acrylate, 1.5 parts by mass of n-octyl-3-mercaptopropionate and 67 parts by mass of a paraffin wax "HNP-11" (from Nippon Seiro Co., Ltd.) as a release agent dissolved at 90° C. were added, and mixed and dispersed for one hour with a dispersion machine having a circulation route "CLEARMIX" (from M Technique Co., Ltd.). Thus, a dispersion containing emulsified particles (oil droplets) was prepared.

Subsequently, to this dispersion, an initiator solution composed of 6 parts by mass of potassium persulfate dissolved in 200 parts by mass of deionized water was added, and polymerization was conducted through heating and stirring of this system at 82° C. for one hour. Thus, a polymer minute particle dispersion (1 HM) containing polymer minute particles (1 hm) was prepared.

(Third Stage Polymerization)

To the polymer minute particle dispersion (1 HM), a solution composed of 11 parts by mass of potassium persulfate dissolved in 400 parts by mass of deionized water was added, and under the temperature condition of 82° C., a polymerizable monomer solution composed of 435 parts by mass of styrene, 130 parts by mass of n-butyl acrylate, 33 parts by mass of methacrylic acid and 8 parts by mass of n-octyl-3-mercaptopropionate was dripped taking one hour. After the dripping, polymerization was conducted through heating and stirring for two hours, and then the temperature was decreased to 28° C. Thus, a polymer minute particle dispersion (1) containing polymer minute particles (a) was produced. The particle diameter of the polymer minute particles (a) of the polymer minute particle dispersion (1) was measured with an electrophoretic light scattering photometer "ELS-800" (from Otsuka Denshi Co., Ltd.), and it was 150 nm in volume-based median diameter. Further, the glass transition point of the polymer minute particles (a) was measured, and it was 45° C.

(2) Preparation of Colorant Minute Particle Dispersion (1)

While a solution composed of 90 parts by mass of sodium dodecyl sulfate dissolved in 1600 parts by mass of deionized water was stirred, 420 parts by mass of carbon black "REGAL 330R" (from Cabot Co.) was gradually added, and subsequently dispersed with a dispersion machine "CLEARMIX" (from M Technique Co., Ltd.). Thus, a colorant minute particle dispersion (1) was prepared. The particle diameter of colorant minute particles of the colorant minute particle dispersion (1) was measured with an electrophoretic light scattering photometer "ELS-800" (from Otsuka Denshi Co., Ltd.), and it was 110 nm.

(3) Production of Toner Base Particles (1)

Into a reaction vessel fitted with a stirring device, a temperature sensor, a cooling tube and a nitrogen introducing device, 300 parts by mass of the polymer minute particle dispersion (1) in terms of solid content, 1400 parts by mass of deionized water, 120 parts by mass of the colorant minute particle dispersion (1), and a solution composed of 3 parts by mass of polyoxyethylene-2-dodecyl ether sodium sulfate dissolved in 120 parts by mass of deionized water were fed. After the solution temperature was adjusted to 30° C., a 5 N sodium hydroxide solution was added to adjust pH to 10.

Subsequently, a solution composed of 35 parts by mass of magnesium chloride dissolved in 35 parts by mass of deionized water was added at 30° C. taking 10 minutes under stirring. After this system was left in this state for three minutes, temperature increase was started, whereby the system was heated to 90° C. taking 60 minutes, and the particle growth reaction continued at 90° C.

In this state, the particle diameter of the associated particles was measured with "Multisizer 3". When the volume-based median diameter ($D_{50}$) reached 6.0 μm, a solution composed of 150 parts by mass of sodium chloride dissolved in 600 parts by mass of deionized water was added to stop the particle growth. Further, through heating and stirring at a solution temperature of 98° C. as a fusing step, fusion of the particles was promoted until the average roundness measured with a flow particle image analyzer "FPIA-2100" reached 0.955. Thereafter, the solution temperature was decreased to 30° C., hydrochloric acid was added to adjust pH to 4.0, and the stirring was stopped.

The dispersion produced at the above step was subjected to solid-liquid separation with a basket type centrifugal separator "MARK III, type No. 60×40+M" (from Matsumoto Machine Mfg. Co., Ltd.) to form a wet cake of the colorant minute particles. The wet cake was washed with 45° C. deionized water with the basket type centrifugal separator until the electric conductivity of the filtrate reached 5 μS/cm, and then transferred to "Flash Jet Dryer" (from Seishin Enterprise Co., Ltd.) and dried until the moisture content reached 0.5 mass %. Thus, toner base particles (1) were produced.

2. Producing Example of Toner Base Particles (2) (Producing Example 1 of Toner Base Particles Having Domain-Matrix Structure)

(1) Preparing Step of Polymer Minute Particle Dispersion (2)

(First Stage Polymerization)

Into a reaction vessel fitted with a stirring device, a temperature sensor, a temperature control device, a cooling tube and a nitrogen introducing device, an anionic surfactant solution composed of 2.0 parts by mass of sodium lauryl sulfate as an anionic surfactant dissolved in advance in 2900 parts by mass of deionized water was fed, and the internal temperature was increased to 80° C. while the solution was stirred at a stirring speed of 230 rpm under a nitrogen gas stream.

To this anionic surfactant solution, 9.0 parts by mass of potassium persulfate (KPS) as a polymerization initiator was added. After the internal temperature was adjusted to 78° C., a monomer solution [1] composed of the following was dripped taking three hours.

| | |
|---|---|
| styrene | 540 parts by mass |
| n-butyl acrylate | 154 parts by mass |
| methacrylic acid | 77 parts by mass |
| n-octyl mercaptan | 17 parts by mass |

After the dripping, polymerization (first stage polymerization) was conducted through heating and stirring at 78° C. for one hour. Thus, a dispersion of polymer minute particles [a1] was prepared.

(Second Stage Polymerization) Formation of Intermediate Layer

In a flask fitted with a stirring device, 51 parts by mass of a paraffin wax (melting point: 73° C.) as an offset inhibitor was added to a solution composed of the following and heated to 85° C. to be dissolved.

| | |
|---|---|
| styrene | 94 parts by mass |
| n-butyl acrylate | 27 parts by mass |
| methacrylic acid | 6 parts by mass |
| n-octyl mercaptan | 1.7 parts by mass |

Thus, a monomer solution [2] was prepared.

Meanwhile, an anionic surfactant solution composed of 2 parts by mass of sodium lauryl sulfate as an anionic surfactant dissolved in 1100 parts by mass of deionized water was heated to 90° C., and to this surfactant solution, 28 parts by mass of the dispersion of polymer minute particles [a1] in terms of solid content of the polymer minute particles [a1] was added. Thereafter, the monomer solution [2] was mixed and dispersed for four hours with a dispersion machine having a circulation route "CLEARMIX" (from M Technique Co., Ltd.). Thus, a dispersion containing emulsified particles having a dispersion diameter of 350 nm was prepared. To this dispersion, an initiator solution composed of 2.5 parts by mass of KPS as a polymerization initiator dissolved in 110 parts by mass of deionized water was added, and polymerization (second stage polymerization) was conducted through heating and stirring of this system at 90° C. for two hours. Thus, a dispersion of polymer minute particles [a11] was prepared.

(Third Stage Polymerization) Formation of Outer Layer

To the dispersion of polymer minute particles [a11], an initiator solution composed of 2.5 parts by mass of KPS as a polymerization initiator dissolved in 110 parts by mass of deionized water was added, and under the temperature condition of 80° C., a monomer solution [3] composed of the following was dripped taking one hour.

| | |
|---|---|
| styrene | 230 parts by mass |
| n-butyl acrylate | 78 parts by mass |
| methacrylic acid | 16 parts by mass |
| n-octyl mercaptan | 4.2 parts by mass |

After the dripping, polymerization (third stage polymerization) was conducted through heating and stirring for three hours. Thereafter, the temperature was decreased to 28° C. Thus, a polymer minute particle dispersion (2) composed of polymer minute particles (2) dissolved in an anionic surfactant solution was prepared.

The glass transition point of the polymer minute particles (2) was 45° C., and the softening point thereof was 100° C.

(2) Preparing Step of Styrene-Acrylic Modified Polyester Minute Particle Dispersion (1)

(2-1) Synthesis of Styrene-Acrylic Modified Polyester (1)

Into a reaction vessel fitted with a nitrogen introducing tube, a dewatering conduit, a stirrer and a thermocouple, the following were put.

| | |
|---|---|
| bisphenol A propylene oxide 2 mol adduct | 500 parts by mass |
| terephthalic acid | 117 parts by mass |
| fumaric acid | 82 parts by mass |
| esterification catalyst (tin octylate) | 2 parts by mass |

Then, condensation polymerization was conducted at 230° C. for eight hours, and the reaction was conducted at 8 kPa for another one hour. After the temperature was decreased to 160° C., a mixture of the following was dripped taking one hour with a dropping funnel.

| | |
|---|---|
| acrylic acid | 10 parts by mass |
| styrene | 30 parts by mass |
| n-butyl acrylate | 7 parts by mass |
| polymerization initiator (di-t-butyl peroxide) | 10 parts by mass |

After the dripping, the addition polymerization reaction was continued for one hour at 160° C. Thereafter, the temperature was increased to 200° C., and the resulting product was left in this state at 10 kPa for one hour, and then acrylic acid, styrene and butyl acrylate were removed. Thus, styrene-acrylic modified polyester (1) was synthesized.

The glass transition point of the styrene-acrylic modified polyester (1) was 60° C., and the softening point thereof was 105° C.

(2-2) Preparation of Styrene-Acrylic Modified Polyester Minute Particle Dispersion (1)

100 parts by mass of the styrene-acrylic modified polyester (1) was milled with a Roundel Mill RM (from TOKUJU Co., Ltd.) and mixed with 638 parts by mass of a sodium lauryl sulfate solution (concentration: 0.26 mass %) prepared in advance, and subjected to ultrasonic dispersion with an ultrasonic homogenizer "US-150T" (from NIHON-SEIKI KAISHA Ltd.) at V-LEVEL of 300 μA for 30 minutes while stirred. Thus, a styrene-acrylic modified polyester minute particle dispersion (1) in which the styrene-acrylic modified polyester (1) having a volume-based median diameter ($D_{50}$) of 250 nm was dispersed was prepared.

(3) Production of Toner Base Particles (2) (Aggregating & Fusing Step-Ripening Step-Washing Step-Drying Step)

Into a reaction vessel fitted with a stirring device, a temperature sensor and a cooling tube, 288 parts by mass of the polymer minute particle dispersion (2) in terms of solid content, 72 parts by mass of the styrene-acrylic modified polyester minute particle dispersion (1) in terms of solid content and 2000 parts by mass of deionized water were poured, and a 5 mol/L sodium hydroxide solution was added to adjust pH to 10.

Thereafter, 40 parts by mass of the above-described colorant minute particle dispersion (1) in terms of solid content was poured. Subsequently, a solution composed of 60 parts by mass of magnesium chloride dissolved in 60 parts by mass of deionized water was added at 30° C. taking 10 minutes under stirring. After this system was left in this state for three minutes, temperature increase was started, whereby the system was heated to 80° C. taking 60 minutes, and the particle growth reaction continued at 80° C.

In this state, the particle diameter of the aggregate particles was measured with "Multisizer 3" (from Beckman Coulter, Inc.). When the volume-based median diameter ($D_{50}$) reached 6.0 μm, a solution composed of 190 parts by mass of sodium chloride dissolved in 760 parts by mass of deionized water was added to stop the particle growth. Further, the temperature was increased, and through heating and stirring at 90° C., fusion of the particles was promoted. When the average roundness (HPF detection number: 4,000 particles), which was measured with a flow particle image analyzer "FPIA-2100" (from Sysmex Co.), reached 0.945, the temperature was decreased to 30° C. Thus, a dispersion of toner base particles (2) was prepared.

The dispersion of toner base particles (2) was subjected to solid-liquid separation with a basket type centrifugal separator "MARK III, type No. 60×40+M" (from Matsumoto Machine Mfg. Co., Ltd.) to form a wet cake of the colorant minute particles. The wet cake was washed with 45° C. deionized water with the basket type centrifugal separator until the electric conductivity of the filtrate reached 5 μS/cm, and then transferred to "Flash Jet Dryer" (from Seishin Enterprise Co., Ltd.) and dried until the moisture content reached 0.5 mass %. Thus, toner base particles (2) having a domain-matrix structure were produced.

3. Producing Example of Toner Base Particles (3) (Producing Example 2 of Toner Base Particles Having Domain-Matrix Structure)

(1) Preparation of Acid Group-Containing Vinyl-Based Polymer Minute Particle Dispersion (1)

(First Stage Polymerization)

Into a reaction vessel fitted with a stirring device, a temperature sensor, a cooling tube and a nitrogen introducing device, 4 parts by mass of polyoxyethylene-2-dodecyl ether sodium sulfate and 3000 parts by mass of deionized water were fed, and the internal temperature was increased to 80° C. while they were stirred at a stirring speed of 230 rpm under a nitrogen gas stream. After the temperature increase, a solution composed of 10 parts by mass of potassium persulfate dissolved in 200 parts by mass of deionized water was added, and the solution temperature was adjusted to 75° C. Then, a monomer mixture solution composed of the following was dripped taking one hour.

| | |
|---|---|
| styrene | 584 parts by mass |
| n-butyl acrylate | 160 parts by mass |
| methacrylic acid | 56 parts by mass |

After the dripping, polymerization was conducted through heating and stirring at 75° C. for two hours. Thus, a dispersion of polymer minute particles [b1] was prepared.

(Second Stage Polymerization)

Into a reaction vessel fitted with a stirring device, a temperature sensor, a cooling tube and a nitrogen introducing device, a solution composed of 2 parts by mass of polyoxyethylene-2-dodecyl ether sodium sulfate dissolved in 3000 parts by mass of deionized water was fed. After the temperature was increased to 80° C., a solution composed of 42 parts by mass of the dispersion of polymer minute particles [b1] in terms of solid content and 70 parts by mass of a microcrystalline wax "HNP-0190" (from Nippon Seiro Co., Ltd.) dissolved at 80° C. in a monomer solution composed of the following was added, and mixed and dispersed for one hour with a dispersion machine having a circulation route "CLEARMIX" (from M Technique Co., Ltd.). Thus, a dispersion containing emulsified particles (oil droplets) was prepared.

| | |
|---|---|
| styrene | 239 parts by mass |
| n-butyl acrylate | 111 parts by mass |
| methacrylic acid | 26 parts by mass |
| n-octyl mercaptan | 3 parts by mass |

Subsequently, to this dispersion, an initiator solution composed of 5 parts by mass of potassium persulfate dissolved in 100 parts by mass of deionized water was added, and polymerization was conducted through heating and stirring of this system at 80° C. for one hour. Thus, a dispersion of polymer minute particles [b2] was prepared.

(Third Stage Polymerization)

To the dispersion of polymer minute particles [b2], a solution composed of 10 parts by mass of potassium persulfate dissolved in 200 parts by mass of deionized water was added, and under the temperature condition of 80° C., a monomer mixture solution composed of the following was dripped taking one hour.

| | |
|---|---|
| styrene | 380 parts by mass |
| n-butyl acrylate | 132 parts by mass |
| methacrylic acid | 39 parts by mass |
| n-octyl mercaptan | 6 parts by mass |

After the dripping, polymerization was conducted through heating and stirring for two hours, and then the temperature was decreased to 28° C. Thus, an acid group-containing vinyl-based polymer minute particle dispersion (1) was prepared.

(2) Synthesis of Styrene-Acrylic Modified Polyester (2)

Into a reaction vessel fitted with a nitrogen introducing tube, a dewatering conduit, a stirrer and a thermocouple, as materials for the polyester polymerization segment, 259 parts by mass of sebacic acid (molecular weight 202.25) as the polycarboxylic acid compound and 259 parts by mass of 1,12-dodecanediol (molecular weight 202.33) as the polyhydric alcohol compound were put, and heated at 160° C. to be dissolved. A solution composed of 46 parts by mass of styrene, 12 parts by mass of n-butyl acrylate and 4 parts by mass of dicumyl peroxide as materials for the vinyl-based polymerization segment and 3 parts by mass of acrylic acid as the co-reactive monomer mixed in advance was dripped taking one hour with a dropping funnel.

The stirring was continued for one hour at 170° C. After polymerization of styrene, n-butyl acrylate and acrylic acid, 2.5 parts by mass of tin (II) 2-ethylhexanoate and 0.2 parts by mass of gallic acid were added, the temperature was increased to 210° C., and reaction was conducted for eight hours. The reaction was conducted at 8.3 kPa for another one hour. Thus, styrene-acrylic modified polyester (2) composed of the vinyl-based polymerization segment and the polyester polymerization segment binding to each other was synthesized.

The melting point (Tm) of the styrene-acrylic modified polyester (2) was measured as described above, namely, by obtaining the DSC curve at a temperature increase rate of 10° C./min with a differential scanning calorimeter "Diamond DSC" (from PerkinElmer Inc.) and taking the endothermic peak top temperature as the melting point, and it was 82.2° C. Further, the molecular weight (Mw) thereof was measured as described above with a GPC "HLC-8120GPC" (from Tosoh Co.), and it was 28,000 in terms of standard styrene.

(3) Preparation of Styrene-Acrylic Modified Polyester Minute Particle Dispersion (2)

30 parts by mass of the styrene-acrylic modified polyester (2) was melted and transferred to an emulsification/dispersion device "CAVITRON CD1010" (from EUROTEC Co., Ltd.) at a transfer speed of 100 parts by mass per minute, keeping the melted state. At the same time as the styrene-acrylic modified polyester (2) in the melted state was transferred, diluted ammonia water (concentration: 0.37 mass %) composed of 70 parts by mass of reagent ammonia water diluted with deionized water in an aqueous solvent tank was transferred to the emulsification/dispersion device at a transfer speed of 0.1 litter per minute while heated to 100° C. with a heat exchanger. The emulsification/dispersion device was operated under the conditions of a rotor's rotation speed of 60 Hz and a pressure of 5 kg/cm$^2$. Thus, a styrene-acrylic modified polyester minute particle dispersion (2) having a volume-based median diameter of 200 nm and a solid content of 30 parts by mass was prepared.

(4) Production of Toner Base Particles (3)

(Aggregating & Fusing Step)

Into a reaction vessel fitted with a stirring device, a temperature sensor, a cooling tube and a nitrogen introducing device, 300 parts by mass (in terms of solid content) of the acid group-containing vinyl-based polymer minute particle dispersion (1), 60 parts by mass (in terms of solid content) of the styrene-acrylic modified polyester minute particle dispersion (2), 1100 parts by mass of deionized water and 40 parts by mass (in terms of solid content) of the above-described colorant minute particle dispersion (1) were fed. After the solution temperature was adjusted to 30° C., a 5 N sodium hydroxide solution was added to adjust pH to 10.

Subsequently, a solution composed of 60 parts by mass of magnesium chloride dissolved in 60 parts by mass of deionized water was added at 30° C. taking 10 minutes under stirring. After this system was left in this state for three minutes, temperature increase was started, whereby the system was heated to 85° C. taking 60 minutes and aggregated at 85° C., and accordingly the particle growth reaction continued. In this state, the particle diameter of the aggregate particles was measured with "Multisizer 3" (from Beckman Coulter, Inc.). When the volume-based median diameter reached 6 μm, a solution composed of 40 parts by mass of sodium chloride dissolved in 160 parts by mass of deionized water was added to stop the particle growth. Further, through heating and stirring at a solution temperature of 80° C. for one hour as a ripening step, fusion of the particles was promoted. When the average roundness (HPF detection number: 4,000 particles) measured with a flow particle image analyzer "FPIA-2100" (from Sysmex Co.) reached 0.948, the temperature was decreased to 30° C. Thus, a dispersion of toner base particles (3) having a domain-matrix structure was prepared.

(Washing Step & Drying Step)

The dispersion of toner base particles (3) was subjected to solid-liquid separation with a basket type centrifugal separator "MARK III, type No. 60×40+M" (from Matsumoto Machine Mfg. Co., Ltd.) to form a wet cake of the toner base particles. The wet cake was washed with 40° C. deionized water with the basket type centrifugal separator until the electric conductivity of the filtrate reached 5 μS/cm, and then transferred to "Flash Jet Dryer" (from Seishin Enterprise Co., Ltd.) and dried until the moisture content reached 0.5 mass %. Thus, toner base particles (3) were produced.

<Production of Toner (Bk-1)> (External Additive Adding Step)

To the toner base particles (1), 0.8 parts by mass of the silica-polymer composite minute particles 1, 0.65 parts by mass of fumed silica (HMDS treatment, degree of hydrophobicity 60%, number average primary particle diameter 30 nm), and 0.25 parts by mass of hydrophobic titania (octyl silane treatment, degree of hydrophobicity 60%, number average primary particle diameter 30 nm) were added and mixed using a Henschel mixer. Thus, toner (Bk-1) was produced.

<Production of Toner (Bk-2) to Toner (Bk-19)>

Toner (Bk-2) to toner (Bk-19) were produced in the same way as the toner (Bk-1), except that the type of the toner base particles and the type and the addition of the silica-polymer composite minute particles were changed to those shown in TABLE 2.

The toner (Bk-17) to the toner (Bk-19) were produced using, instead of the silica-polymer composite minute particles, calcium titanate (TC-100 from Titan Kogyo, Ltd.), strontium titanate (SW-100 from Titan Kogyo, Ltd.) and silica (YC100C-SP3 from Admatechs Company Limited), respectively. The toner (Bk-1) to the toner (Bk-14) are of toner of the present invention, whereas the toner (Bk-15) to the toner (Bk-19) are of toner of comparative examples.

Producing Example of Developers [Bk-1] to [Bk-19]

Developers [Bk-1] to [Bk-19] were produced by mixing the toners (Bk-1) to (Bk-19) with ferrite carriers coating silicone polymer and having a volume average particle diameter of 60 μm in such a way that the toner concentration reached 6%.

Examples 1 to 14 and Comparative Examples 1 to 5

By combining thus-produced developers [Bk-1] to [Bk-19] with their corresponding toners (Bk-1) to (Bk-19), the following actual imaging test was conducted for evaluation of non-uniform charging using a digital copier "bizhub PRO C450" (from Konica Minolta Inc.), the charging device of which was changed to the one using the charging roller shown in FIG. 3.

The voltages applied to the charging roller of the charging device were as follows.

DC Voltage (Vdc): −500 V

AC Voltage (Vac): 1300 V

Frequency of AC Voltage: 1000 Hz

[Evaluation of Non-Uniform Charging]

Under a normal temperature and normal humidity environment (temperature: 20° C., humidity: 55% RH), using A4 plain paper as an image support, first, one halftone image having an absolute reflection density of 0.50 (referred to as the "initial image") was printed; next, 50,000 images having a pixel ratio of 5% were printed in a one-by-one intermittence mode; and then one halftone image having a reflection density of 0.50 (referred to as the "50,001$^{th}$ image" as the image printed after the above-described 50,000 images had been printed) was printed. In each of the initial image and the 50,001$^{th}$ image, the reflection density was measured at 20 points, and the difference between the maximum value and the minimum value was calculated. When the difference between the maximum value and the minimum value was more than 0.05, it was determined as bad because it could cause a problem in practice use. The density was measured with a reflection densitometer "RD-919" (from Macbeth).

TABLE 2

| | TONER | | EXTERNAL ADDITIVE | | | EVALUATION OF NON-UNIFORM CHARGING | |
|---|---|---|---|---|---|---|---|
| | TONER No. | TONER BASE PARTICLES No. | No. | NUMBER AVERAGE PRIMARY PARTICLE DIAMETER (nm) | ADDITION (parts by mass) | INITIAL IMAGE | 50,001$^{th}$ IMAGE |
| EXAMPLE 1 | (Bk-1) | (1) | SILICA-POLYMER COMPOSITE PARTICLES 1 | 106 | 0.8 | 0.02 | 0.03 |
| EXAMPLE 2 | (Bk-2) | (3) | SILICA-POLYMER COMPOSITE PARTICLES 1 | 106 | 0.8 | 0.01 | 0.02 |
| EXAMPLE 3 | (Bk-3) | (2) | SILICA-POLYMER COMPOSITE PARTICLES 1 | 106 | 0.8 | 0.02 | 0.03 |
| EXAMPLE 4 | (Bk-4) | (3) | SILICA-POLYMER COMPOSITE PARTICLES 2 | 50 | 0.8 | 0.01 | 0.03 |
| EXAMPLE 5 | (Bk-5) | (3) | SILICA-POLYMER COMPOSITE PARTICLES 3 | 500 | 0.8 | 0.01 | 0.03 |
| EXAMPLE 6 | (Bk-6) | (3) | SILICA-POLYMER COMPOSITE PARTICLES 4 | 45 | 0.8 | 0.01 | 0.04 |
| EXAMPLE 7 | (Bk-7) | (3) | SILICA-POLYMER COMPOSITE PARTICLES 5 | 550 | 0.8 | 0.01 | 0.04 |
| EXAMPLE 8 | (Bk-8) | (3) | SILICA-POLYMER COMPOSITE PARTICLES 6 | 113 | 0.8 | 0.01 | 0.04 |
| EXAMPLE 9 | (Bk-9) | (3) | SILICA-POLYMER COMPOSITE PARTICLES 7 | 95 | 0.8 | 0.01 | 0.04 |
| EXAMPLE 10 | (Bk-10) | (3) | SILICA-POLYMER COMPOSITE PARTICLES 10 | 108 | 0.8 | 0.01 | 0.03 |
| EXAMPLE 11 | (Bk-11) | (3) | SILICA-POLYMER COMPOSITE PARTICLES 11 | 103 | 0.8 | 0.01 | 0.03 |
| EXAMPLE 12 | (Bk-12) | (3) | SILICA-POLYMER COMPOSITE PARTICLES 1 | 106 | 0.3 | 0.02 | 0.04 |
| EXAMPLE 13 | (Bk-13) | (3) | SILICA-POLYMER COMPOSITE PARTICLES 1 | 106 | 2.0 | 0.01 | 0.02 |
| EXAMPLE 14 | (Bk-14) | (3) | SILICA-POLYMER COMPOSITE PARTICLES 1 | 106 | 5.0 | 0.02 | 0.04 |
| COMPARATIVE EXAMPLE 1 | (Bk-15) | (3) | SILICA-POLYMER COMPOSITE PARTICLES 8 | 121 | 0.8 | 0.02 | 0.08 |
| COMPARATIVE EXAMPLE 2 | (Bk-16) | (3) | SILICA-POLYMER COMPOSITE PARTICLES 9 | 85 | 0.8 | 0.02 | 0.07 |
| COMPARATIVE EXAMPLE 3 | (Bk-17) | (3) | CALCIUM TITANATE | 110 | 0.8 | 0.02 | 0.11 |
| COMPARATIVE EXAMPLE 4 | (Bk-18) | (3) | STRONTIUM TITANATE | 110 | 0.8 | 0.02 | 0.14 |
| COMPARATIVE EXAMPLE 5 | (Bk-19) | (3) | SILICA | 100 | 0.8 | 0.02 | 0.12 |

As it is obvious from TABLE 2, with Examples 1 to 14 of the image forming method of the present invention, even after the actual imaging of 50,000 images, image defects, which could be caused by non-uniform charging, are prevented from occurring, and high-quality images can be obtained, whereas with Comparative Examples 1 to 5, after the actual imaging of 50,000 images, density non-uniformity becomes significant in the following images.

This application is based upon and claims the benefit of priority under 35 USC 119 of Japanese Patent Application No. 2014-037793 filed on Feb. 28, 2014, the entire disclosure of which, including the specification, claims, drawings and abstract, is incorporated herein by reference in its entirety.

What is claimed is:

1. An image forming method comprising:

charging a surface of an electrostatic latent image holder with a charging roller;

exposing the charged surface so as to form an electrostatic latent image; and developing the formed electrostatic latent image with toner, wherein the toner contains at least a toner base particle and an external additive minute particle, the external additive minute particle contains a silica-polymer composite minute particle, a silicon atom abundance ratio obtained from abundances of a carbon atom, an oxygen atom and a silicon, atom present on an outermost surface and within 3 nm from the outermost surface in a depth direction of the silica-polymer composite minute particle measured with an x-ray photoelectron spectrometer satisfies at least a condition A below:

$$15.0 \text{ atm } \% \leq \text{silicon atom abundance ratio } (\{Si/(C+O+Si)\}\times 100) \leq 30.0 \text{ atm } \%, \quad \text{[Condition A]}$$

the toner base particle has a domain-matrix structure, the matrix contains an acid group-containing vinyl-based polymer, the domain contains a polymer formed of a vinyl-based polymerization segment and a polyester polymerization segment binding to each other, and the polyester polymerization segment is crystalline polyester.

2. The image forming method according to claim 1, wherein the silica-polymer composite minute particle has a number average primary particle diameter of 50 nm to 500 nm.

3. The image forming method according to claim 1, wherein, as a hydrophobizing agent of the silica-polymer composite minute particle, at least methacryloxypropyltrimethoxysilane is used.

4. The image forming method according to claim 1, wherein, as a hydrophobizing agent of the silica-polymer composite minute particle, at least hexamethyldisilazane is used.

5. The image forming method according to claim 1, wherein a silica part of the silica-polymer composite minute particle is formed of a colloidal silica minute particle.

6. The image forming method according to claim 1, wherein a silica part of the silica-polymer composite minute particle has a particle diameter of 10 nm to 70 nm.

7. The image forming method according to claim 1, wherein the toner base particle has a number average particle diameter of 4.0 μm to 6.8 μm.

8. The image forming method according to claim 1, wherein the toner base particle has an average roundness of 0.930 to 0.965.

9. The image forming method according to claim further comprising applying a direct current and an alternating current to the charging roller.

10. The image forming method according to claim 1, wherein the charging roller has a surface roughness Rz of 5 μm to 10 μm.

* * * * *